US010230185B2

(12) United States Patent
Hirakawa

(10) Patent No.: US 10,230,185 B2
(45) Date of Patent: Mar. 12, 2019

(54) CONNECTOR DEVICE

(71) Applicant: DAI-ICHI SEIKO CO., LTD., Kyoto-shi, Kyoto (JP)

(72) Inventor: Takeshi Hirakawa, Machida (JP)

(73) Assignee: DAI-ICHI SEIKO CO., LTD., Kyoto-shi, Kyoto (JP)

( * ) Notice: Subject to any disclaimer, the term of this patent is extended or adjusted under 35 U.S.C. 154(b) by 0 days.

(21) Appl. No.: 15/847,791

(22) Filed: Dec. 19, 2017

(65) Prior Publication Data

US 2018/0175525 A1 Jun. 21, 2018

(30) Foreign Application Priority Data

Dec. 21, 2016 (JP) ..... 2016-247625

(51) Int. Cl.
*H01R 12/70* (2011.01)
*H01R 12/71* (2011.01)
*H01R 13/641* (2006.01)

(52) U.S. Cl.
CPC ..... *H01R 12/7005* (2013.01); *H01R 12/716* (2013.01); *H01R 13/641* (2013.01)

(58) Field of Classification Search
CPC ..... H01R 12/716
(Continued)

(56) References Cited

U.S. PATENT DOCUMENTS 5,120,256 A * 6/1992 Walden ..... H01R 12/707 439/553
6,500,013 B1 * 12/2002 Wang ..... H01R 12/598 439/108

(Continued)

FOREIGN PATENT DOCUMENTS

| | | |
|---|---|---|
| JP | 2000-268904 | 9/2000 |
| JP | 2005-050702 | 2/2005 |
| JP | 2011-243332 | 12/2011 |
| JP | 2013-145687 | 7/2013 |
| JP | 2016-038937 | 3/2016 |
| JP | 3206973 | 10/2016 |
| JP | 2016-207407 | 12/2016 |
| TW | M335832 | 7/2008 |
| WO | 2011/142132 | 11/2011 |

OTHER PUBLICATIONS

Extended Search Report in corresponding European Application No. 17206149.1, dated Apr. 26, 2018, 9 pages.

*Primary Examiner* — Neil Abrams
(74) *Attorney, Agent, or Firm* — Soei Patent & Law Firm

(57) ABSTRACT

A connector device includes a first connector and a second connector. A first regulating member attached to the first insulating housing of the first connector and a second regulating member attached to the second insulating housing of the second connector include projecting portions, respectively. A first projecting portion of either one of the first and second regulating members provides a second projecting portion of the other regulating member with a first elastic force acting in a first direction in which the first and second insulating housings separate from each other. Additionally, the first projecting portion provides the second projecting portion with a second elastic force acting in a second direction in which the first and second insulating housings move toward each other. The regulating members also form latch members that act to separate the connectors towards a placed or initial state (e.g., FIGS. 10A, 10B) until a latching or retention position is reached in order to prevent the conductive terminals from engagement with the connectors in a half-fitted state (e.g., FIGS. 11A, 11B).

18 Claims, 24 Drawing Sheets

(58) Field of Classification Search
USPC ..... 439/74
See application file for complete search history.

(56) References Cited

U.S. PATENT DOCUMENTS 6,902,411 B2 * 6/2005 Kubo ..... H01R 13/6275 439/74
7,128,581 B2 * 10/2006 Igarashi ..... H01R 12/716 439/74
8,052,457 B2 * 11/2011 Miyazaki ..... H01R 12/714 439/357
8,408,931 B2 * 4/2013 Sato ..... H01R 12/7052 439/357
8,840,407 B2 * 9/2014 Nose ..... H01R 12/716 439/607.35
8,845,339 B2 * 9/2014 Ono ..... H01R 12/7052 439/74
9,124,011 B2 * 9/2015 Miyazaki ..... H01R 12/716
9,153,892 B2 * 10/2015 Tanaka ..... H01R 12/7052
9,331,406 B2 * 5/2016 Watanabe ..... H01R 12/7011
9,362,637 B2 * 6/2016 Hasegawa ..... H01R 12/716
9,397,423 B2 * 7/2016 Suzuki ..... H01R 12/716
9,425,526 B2 * 8/2016 Uratani ..... H01R 13/6473
9,537,244 B2 * 1/2017 Miyazaki ..... H01R 12/73
9,577,379 B2 * 2/2017 Arichika ..... H01R 13/6271
9,601,849 B2 * 3/2017 Hirakawa ..... H01R 12/7076
9,620,874 B2 * 4/2017 Takemoto ..... H01R 12/716
9,640,893 B2 * 5/2017 Miyazaki ..... H01R 13/42
9,825,386 B2 * 11/2017 Lee ..... H01R 12/73
9,843,117 B2 * 12/2017 Yoshioka ..... H01R 12/716
9,887,473 B2 * 2/2018 Lee ..... H01R 12/716
2015/0140841 A1 5/2015 Watanabe
2015/0270633 A1 * 9/2015 Kodaira ..... H01R 12/79 439/357
2018/0054013 A1 * 2/2018 Osaki ..... H01R 12/79
2018/0069331 A1 * 3/2018 Hirakawa ..... H01R 12/57
2018/0175525 A1 * 6/2018 Hirakawa ..... H01R 13/641

* cited by examiner

CONNECTOR DEVICE

CROSS-REFERENCE TO RELATED APPLICATIONS

This application is based upon and claims the benefit of priority from Japanese Patent Application No. 2016-247625, filed Dec. 21, 2016, the entire contents of which are incorporated herein by reference.

BACKGROUND

1. Field

The present disclosure relates to a connector device.

2. Disclosure of the Related Art

Japanese Unexamined Patent Publication No. 2011-243332 discloses a connector device of board-to-board connection, in which circuit boards (for example, flexible printed circuits (FPC)) are connected. The connector device includes a plug connector mounted on a first circuit board, and a receptacle connector mounted on a second circuit board.

The plug connector includes: a first housing placed on the first circuit board; a plurality of first contacts (conductive terminals) arranged in a predetermined direction and attached to the first housing; and a first solder peg forming part of a sensing switch to sense establishment of fitting and attached to the first housing. The receptacle connector includes: a second housing placed on the second circuit board; a plurality of second contacts arranged in a predetermined direction and attached to the second housing; and a second solder peg forming part of the sensing switch and attached to the second housing.

When the plug connector is inserted into the receptacle connector, the first contacts contact the second contacts corresponding thereto at a predetermined pressure. In this manner, the first circuit board is electrically connected with the second circuit board. Thereafter, when the plug connector is further inserted into the receptacle connector, the first solder peg contacts the second solder peg. In this manner, the sensing switch forms a closed circuit, and establishment of fitting is sensed. Specifically, the height of the contact point between the first and the second contacts from the first circuit board after establishment of fitting is set higher than the height of the contact point between the first and the second solder pegs from the first circuit board. For this reason, in the connector device of Japanese Unexamined Patent Publication No. 2011-243332, the first and the second contacts contact earlier than contact between the first and the second pegs, in fitting. Accordingly, conduction between the first and the second contacts can be sensed, according to whether the sensing switch forms a closed circuit. However, the first and second solder pegs are required in Japanese Unexamined Patent Publication No. 2011-243332 to ensure that a closed circuit has been formed.

SUMMARY

A connector device according to an aspect of the present disclosure includes: a first connector including a first insulating housing, a plurality of first conductive terminals attached to the first insulating housing, and at least one first regulating member attached to the first insulating housing; and a second connector including a second insulating housing, a plurality of second conductive terminals attached to the second insulating housing, and at least one second regulating member attached to the second insulating housing. The first insulating housing is provided with a fitting projecting portion standing straight from a bottom surface, and the second insulating housing is provided with a receiving recessed portion capable of receiving the fitting projecting portion. Each of the first and the second regulating members includes a projecting portion. In a fitted state in which the fitting projecting portion is received in the receiving recessed portion, the projecting portion of the first regulating member projects toward the second regulating member, and the projecting portion of the second regulating member projects toward the first regulating member. A first projecting portion of either one of the first and the second regulating members provides a second projecting portion of the other regulating member with a first elastic force acting in a first direction which urges the first and the second insulating housings to separate from each other, in a state before the first projecting portion moves across the second projecting portion of the other regulating member, and provides the second projecting portion with a second elastic force acting in a second direction which the first and the second insulating housings move toward each other, in a state after the first projecting portion moves across the second projecting portion of the other, to electrically connect the first conductive terminals with the second conductive terminals.

The detailed description given herein below and the accompanying drawings are given by way of illustration only.

DETAILED DESCRIPTION

Figure 1:
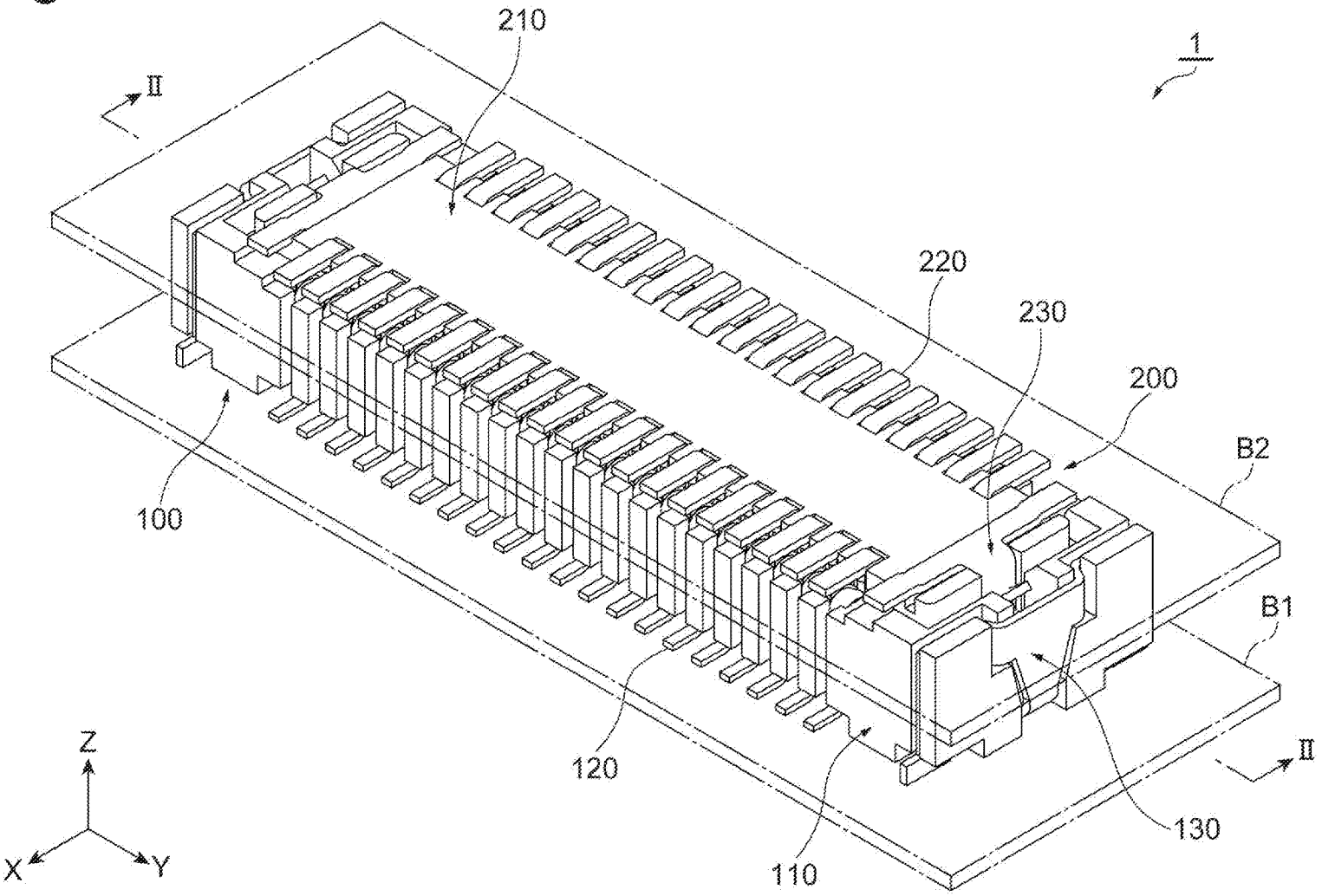
FIG. 1 is a perspective view illustrating an example (first example) of a connector device.

Exemplary embodiments described below are provided as examples for explaining the present invention. At least one of the exemplary embodiments includes latch members that prevent connectors from contacting in a half-fitted state.

Overview

Example 1

A connector device includes: a first connector including a first insulating housing, a plurality of first conductive terminals attached to the first insulating housing, and at least one first regulating member attached to the first insulating housing; and a second connector including a second insulating housing, a plurality of second conductive terminals attached to the second insulating housing, and at least one second regulating member attached to the second insulating housing. The first insulating housing is provided with a fitting projecting portion standing straight from a bottom surface, and the second insulating housing is provided with a receiving recessed portion capable of receiving the fitting projecting portion. Each of the first and the second regulating members includes a projecting portion. In a fitted state in which the fitting projecting portion is received in the receiving recessed portion, the projecting portion of the first regulating member projects toward the second regulating member, and the projecting portion of the second regulating member projects toward the first regulating member. A first projecting portion of either one of the first and the second regulating members may be configured to provide a second projecting portion of the other regulating member with a first elastic force acting in a first direction which urges the first and the second insulating housings to separate from each other, in a state before the projecting portion of the one moves across the projecting portion of the other. Additionally, the first projection portion may be configured to provide the second projecting portion with a second elastic force acting in a second direction which urges the first and the second insulating housings to move toward each other, in a state after the projecting portion of the one moves across the projecting portion of the other. The proximity and/or contact between the first and second insulating housings operates to electrically connect the first conductive terminals with the second conductive terminals.

The connector device may have a structure in which the first projecting portion provides the second projecting portion of the other regulating member with a first elastic force (repulsive force) acting in the first direction which urges the first and the second insulating housings to separate from each other, in the state before the first projecting portion moves across the second projecting portion. For this reason, until the first projecting portion moves across the second projecting portion, the first elastic force may act between the projecting portions of the first and the second regulating members to separate the first and the second insulating housings from each other and achieve a non-fitted state in which the first connector is not electrically connected to the second connector. On the other hand, the first projecting portion may be configured to provide the second projecting portion of the other regulating member with a second elastic force (pull-in force) acting in the second direction which urges the first and the second insulating housings to move toward each other, in the state after the projecting portion of the one moves across the projecting portion of the other. For this reason, after the first projecting portion moves across the second projecting portion, the second elastic force may act between the projecting portions of the first and the second regulating members, to bring the first and the second insulating housings close to each other, and achieve a fitted state in which electrical connection between the first connector and the second connector is established. The connectors may be forcibly set to either of the non-fitted state or the fitted state, with the first and the second elastic forces alternatively generated between the first and the second conductive terminals. This structure prevents a half-fitted state between the connectors. In this disclosure, the "half-fitted state" is defined as the state where the connectors are incompletely fitted, such as the state in which the plug connector is slanted or non-vertical with respect to the receptacle connector. The term fitted state may be understood to refer to a closed electrical connection. On the other hand, the term non-fitted state may be understood to refer to an open electrical connection. The term half-fitted state may indicate an indeterminate state in which the electrical connection may or may not be closed, or may unintentionally alternate between closed and open electrical states.

Example 2

In the connector device according to another example, the projecting portions of the first and the second regulating members described in example 1 may each have a mountain-like shape that has a maximum amount of projection at a peak of the mountain-like shape, and has a decreasing amount of projection toward the first and second directions. This structure enables the first projecting portion to alternatively cause the first and the second elastic forces to act on the second projecting portion of the other regulating member, with a very simple shape.

Example 3

The connector device according to yet another example may have a structure in which at least one of the first conductive terminals described with respect to example 1 includes a projecting portion projecting toward the corresponding second conductive terminal in a fitted state. At least one of the second conductive terminals may include a projecting portion that projects toward the corresponding first conductive terminal in the fitted state, wherein a third projecting portion of either one of the first and the second conductive terminals may be configured to provide a fourth projecting portion of the other conductive terminal with a third elastic force acting in a direction which urges the first and the second insulating housings to separate from each other, in a state before the third projecting portion moves across the fourth projecting portion of the other conductive terminal. Additionally, the third projecting portion may be configured to provide the fourth projecting portion with a fourth elastic force acting in a direction which urges the first and the second insulating housings to move toward each other, in a state after the third projecting portion moves across the fourth projecting portion. The third projecting portion may be configured to provide the fourth projecting portion of the other conductive terminal with a third elastic force (repulsive force) acting in a direction which urges the first and the second insulating housings to separate from each other, in a state before the third projecting portion moves across the fourth projecting portion. For this reason, until the third projecting portion moves across the fourth projecting portion, the third elastic force may act between the projecting portions of the first and the second conductive terminals to separate the first and the second insulating housings from each other and achieve a non-fitted state in which the first connector is not fitted with the second connector. On the other hand, the third projecting portion may be configured to provide the fourth projecting portion of the other conductive terminal with a fourth elastic force (pull-in force) acting in a direction which urges the first and the second insulating housings to move toward each other, after the third projecting portion moves across the fourth projecting portion. For this reason, after the third projecting portion moves across the fourth projecting portion, the fourth elastic force may act between the projecting portions of the first and the second conductive terminals, to bring the first and the second insulating housings close to each other, and achieve a fitted state in which an electrical connection between the first connector and the second connector is established. As described above, the connectors may be forcibly set to either of the non-fitted state or the fitted state, with the third and the fourth elastic forces generated between the first and the second regulating members. This structure prevents a half-fitted state between the connectors.

Example 4

The connector device according to a further example may have a structure in which the fourth elastic force is smaller than the first elastic force described in example 3, in a state after the third projecting portion of either one of the first and the second conductive terminals moves across the fourth projecting portion of the other conductive terminal, and before the first projecting portion of either one of the first and the second regulating members moves across the second projecting portion of the other regulating member. In this case, the third projecting portion moves across the projecting portion of the other conductive terminal, before the first projecting portion moves across the second projecting portion of the other regulating member, and the fourth elastic force is generated between the projecting portions of the first and the second conductive terminals. However, the fourth elastic force is smaller than the first elastic force. For this reason, until the first projecting portion moves across the second projecting portion of the other regulating member, the first elastic force separates the first and the second insulating housings from each other, to achieve the non-fitted state in which the first connector is not fitted with the second connector. In other words, the fitted state is created for the first time, not only when the projecting portions of the first and the second conductive terminals are engaged but also when the projecting portions of the first and the second regulating members are engaged. As a result, the half-fitted state between the non-fitted state and the fitted state may be avoided.

Example 5

An example connector device may have a structure in which the projecting portion of one or both of the first and the second conductive terminals described at example 3 or 4 has a mountain-like shape that has a maximum amount of projection at a peak of the mountain-like shape, and has a decreasing amount of projection toward the first and second directions. This structure enables the projecting portion of either one of the first and the second conductive terminals to cause the third and the fourth elastic forces to act on the projecting portion of the other conductive terminal, with a very simple shape.

Example 6

A further example connector device may have a structure in which the first insulating housing described in one or more of examples 3 to 5 may include a first mounting surface turned down on a first circuit board, in a state where the first connector is mounted on the first circuit board, and a first opposed surface opposed to the first mounting surface and positioned on a distal end side of the fitting projecting portion standing straight from the bottom surface. The second insulating housing may include a second mounting surface turned down on a second circuit board, in a state where the second connector is mounted on the second circuit board, and a second opposed surface opposed to the second mounting surface and positioned on an opened side of the receiving recessed portion. Each of the projecting portions of the first and the second regulating members may have a mountain-like shape that decreases a projecting quantity as the projecting portion goes away from a peak thereof toward the first and second directions. Additionally, each of the projecting portions of the first and the second conductive terminals may have a mountain-like shape that has a maximum amount of projection at a peak of the mountain-like shape, and has a decreasing amount of projection toward the first and second directions. In a first positional relation (A), the peak of the projecting portion of the first conductive terminals may be positioned in the first opposed surface side beyond the peak of the projecting portion of the first regulating member in the first and second directions, and the peak of the projecting portion of the second regulating member may be positioned in the second opposed surface side beyond the peak of the projecting portion of the second conductive terminals in the first and second directions. In a second positional relation (B), the peak of the projecting portion of the first regulating member may be positioned in the first opposed surface side beyond the peak of the projecting portion of the first conductive terminals in the first and second directions, and the peak of the projecting portion of the second conductive terminals may be positioned in the second opposed surface side beyond the peak of the projecting portion of the second regulating member in the first and second directions. In this case, because the peaks of the projecting portions of the first and the second conductive terminals and the peaks of the projecting portions of the first and the second regulating members have the positional relation (A) or (B), the first to the fourth elastic forces are effectively generated.

Example 7

Yet another example connector device may have a structure in which the first regulating member of example 6 includes an attached portion attached to the first circuit board, wherein the second regulating member includes an attached portion attached to the second circuit board. In this case, the regulating members may also have a function similar to the attached portions, namely to attach the respective connectors to the respective corresponding circuit boards. This simplified structure may use fewer members as compared to other examples, thereby reducing the cost.

Example 8

A connector device according to a further example may have a structure in which the first and the second regulating members as described in one or more of the examples 1 to 7 may abut against each other, but in which the first and the second conductive terminals do not abut against each other, in a state in which the fitting projecting portion is not received in the receiving recessed portion and external force is not applied thereto. In this case, no electricity flows between the first and the second conductive terminals. This structure facilitates selection of the connector device in the non-fitted state by execution of a continuity test.

Example 9

Another example connector device may have a structure in which the fitting projecting portion and the receiving recessed portion as described in any one of the examples 1 to 8 may include wall portions opposed to each other in the fitted state. The first regulating member and the first conductive terminals may be arranged in the wall portion of the receiving recessed portion, and the second regulating member and the second conductive terminals may be arranged in the wall portion of the fitting projecting portion. Additionally, the projecting portions of the first regulating member and the first conductive terminals may be configured to project outward from the wall portion of the fitting projecting portion in the fitted state, and the projecting portions of the second regulating member and the second conductive terminals may be configured to project inward from the wall portion of the receiving recessed portion in the fitted state. In this state, the first and second regulating members contact each other and the first and second conductive terminals contact each other, in a direction in which the wall portions of the fitting projecting portion and the receiving recessed portion are opposed. This structure reduces the space in which the first and second regulating members contact each other and the first and second conductive terminals contact each other, in the fitting direction of the connectors. This structure enables reduction in size of the connector device.

Example 10

Yet another example connector device may have a structure similar to that described in any one of the examples 1 to 9, in which the first connector includes a pair of first regulating members, and in which the second connector includes a pair of second regulating members. Additionally, the first regulating members may be positioned to interpose the first conductive terminals therebetween in a direction in which the first conductive terminals are arranged, and the second regulating members may be positioned to interpose the second conductive terminals therebetween in a direction in which the second conductive terminals are arranged. In this case, the first regulating members positioned on both sides of the first conductive terminals are engaged with the second regulating members positioned on both sides of the second conductive terminals. This structure retains the fitted state of the first and the second connectors on both ends of the connector device. Accordingly, when the first and the second connectors are fitted with each other, the connectors remain securely engaged.

Outline of Connector Device

Figure 2:
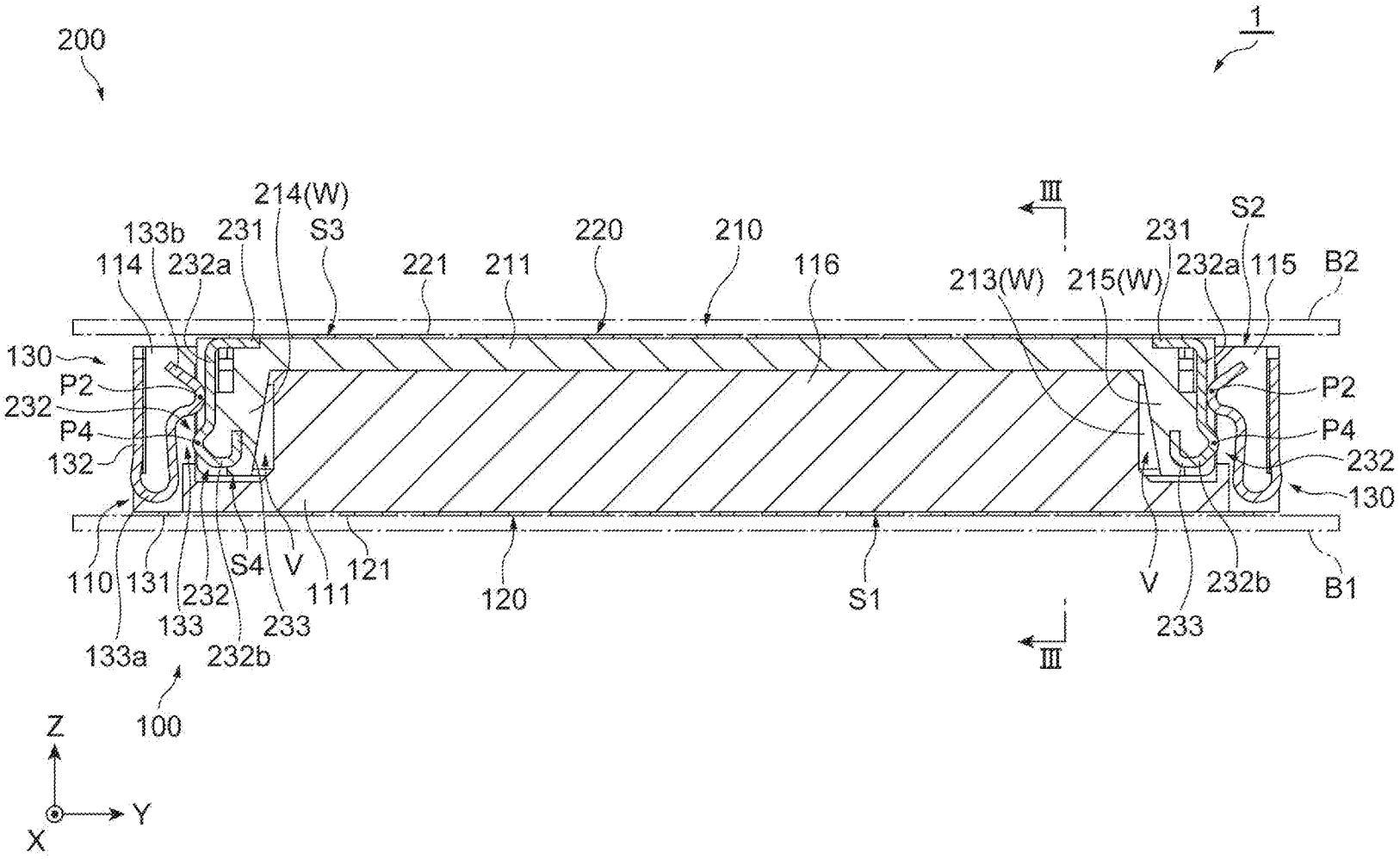
FIG. 2 is a cross-sectional view taken along line II-II of FIG. 1.
Figure 3:
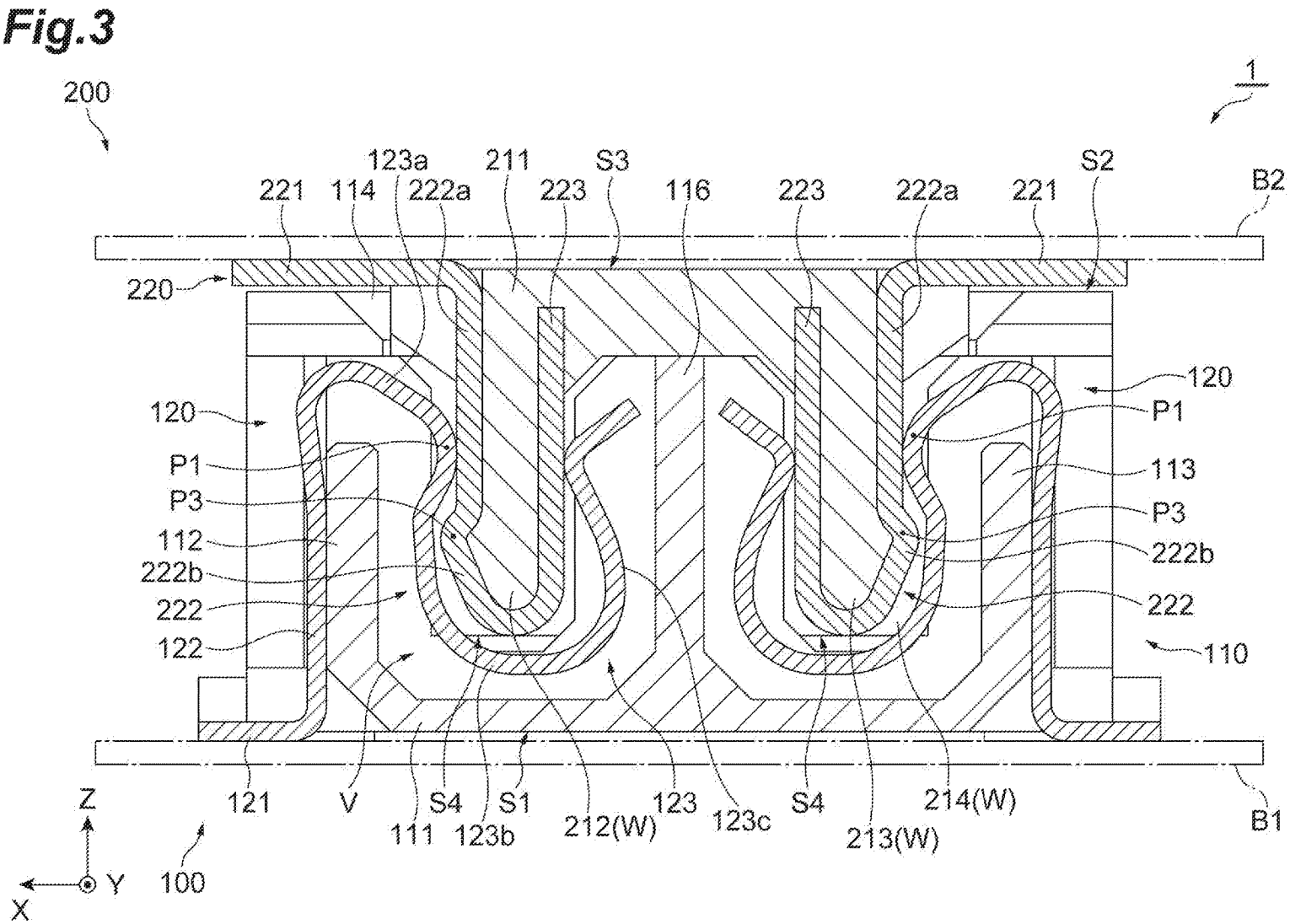
FIG. 3 is a cross-sectional view taken along line III-III of FIG. 2.

First, the following is an explanation of an outline of a connector device 1. As illustrated in FIG. 1 to FIG. 3, the connector device 1 includes a receptacle connector 100 (second connector) and a plug connector 200 (first connector). The receptacle connector 100 is mounted on a circuit board B1 (second circuit board). The plug connector 200 is mounted on a circuit board B2 (first circuit board) different from the circuit board B1. In the drawings other than FIG. 1 to FIG. 3, illustration of the circuit boards B1 and B2 is omitted.

The receptacle connector 100 and the plug connector 200 are configured to be fittable with each other. The plug connector 200 is fitted with the receptacle connector 100, to electrically connect the circuit boards B1 and B2 each other. Specifically, the connector device 1 has a function of electrically and physically connecting the circuit boards B1 and B2. Printed boards (such as flexible printed boards) of various types may be used as the circuit boards B1 and B2.

Structure of Receptacle Connector

Figure 4:
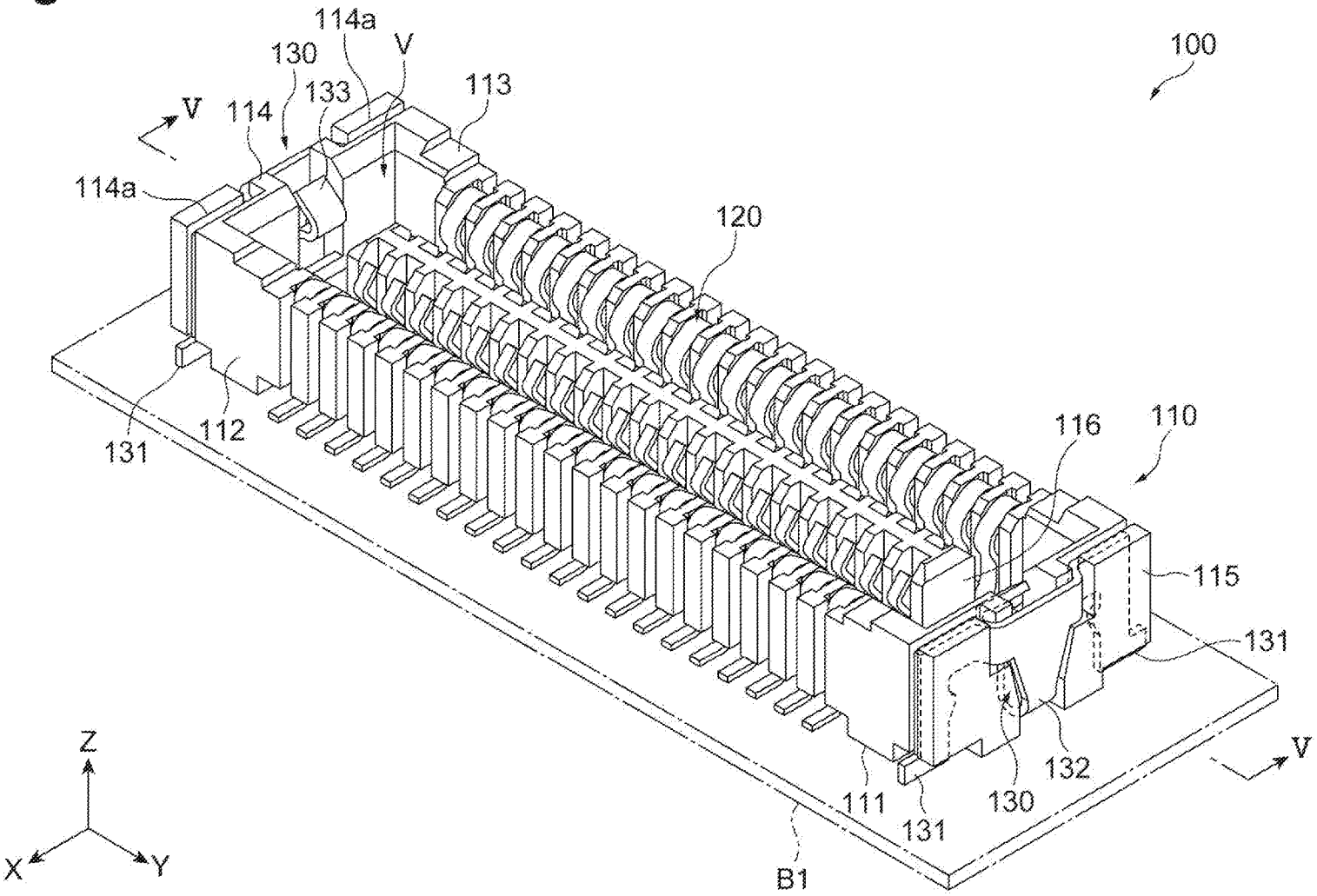
FIG. 4 is a perspective view illustrating a receptacle connector forming the connector device of FIG. 1.
Figure 5:
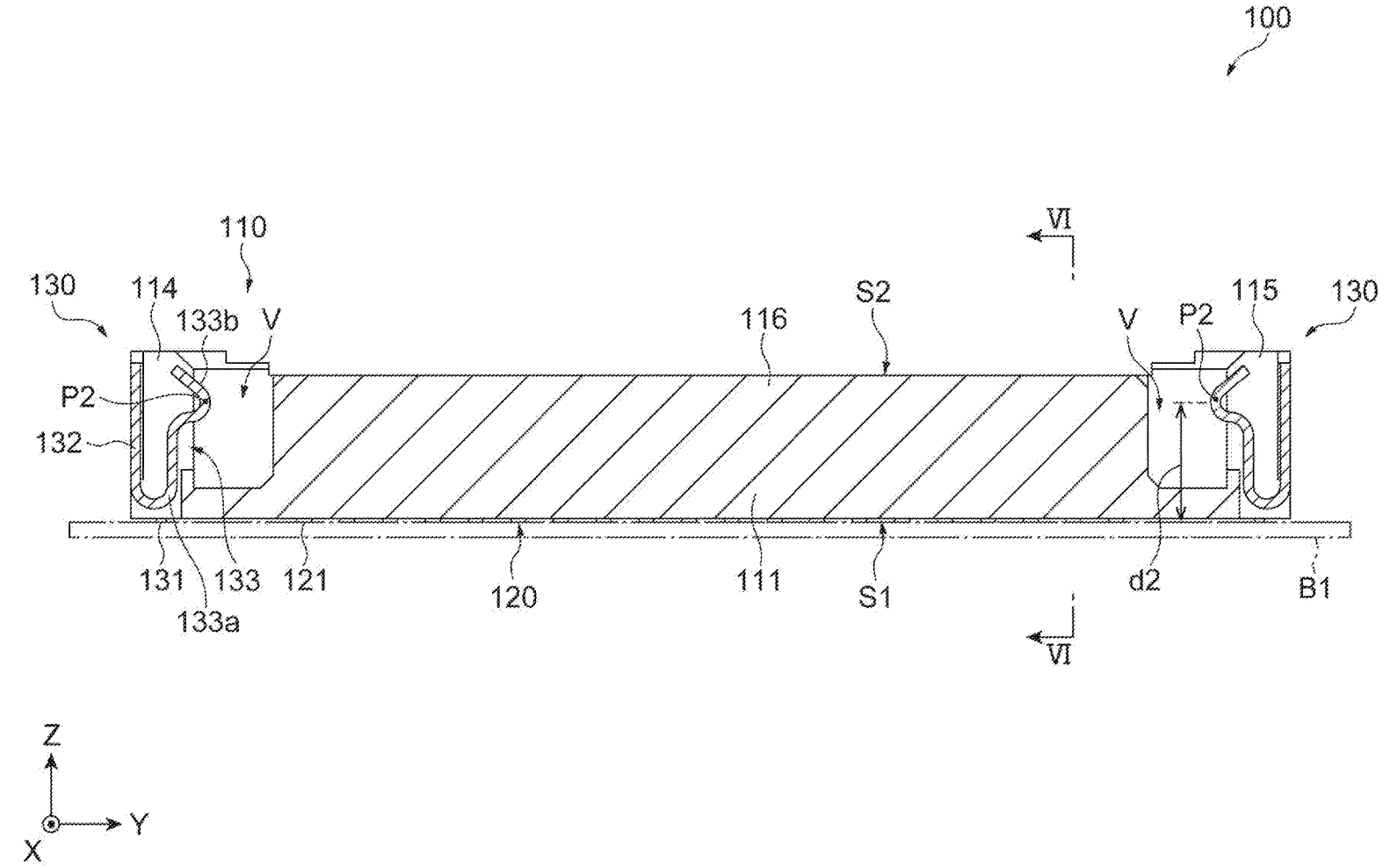
FIG. 5 is a cross-sectional view taken along line V-V of FIG. 4.
Figure 6:
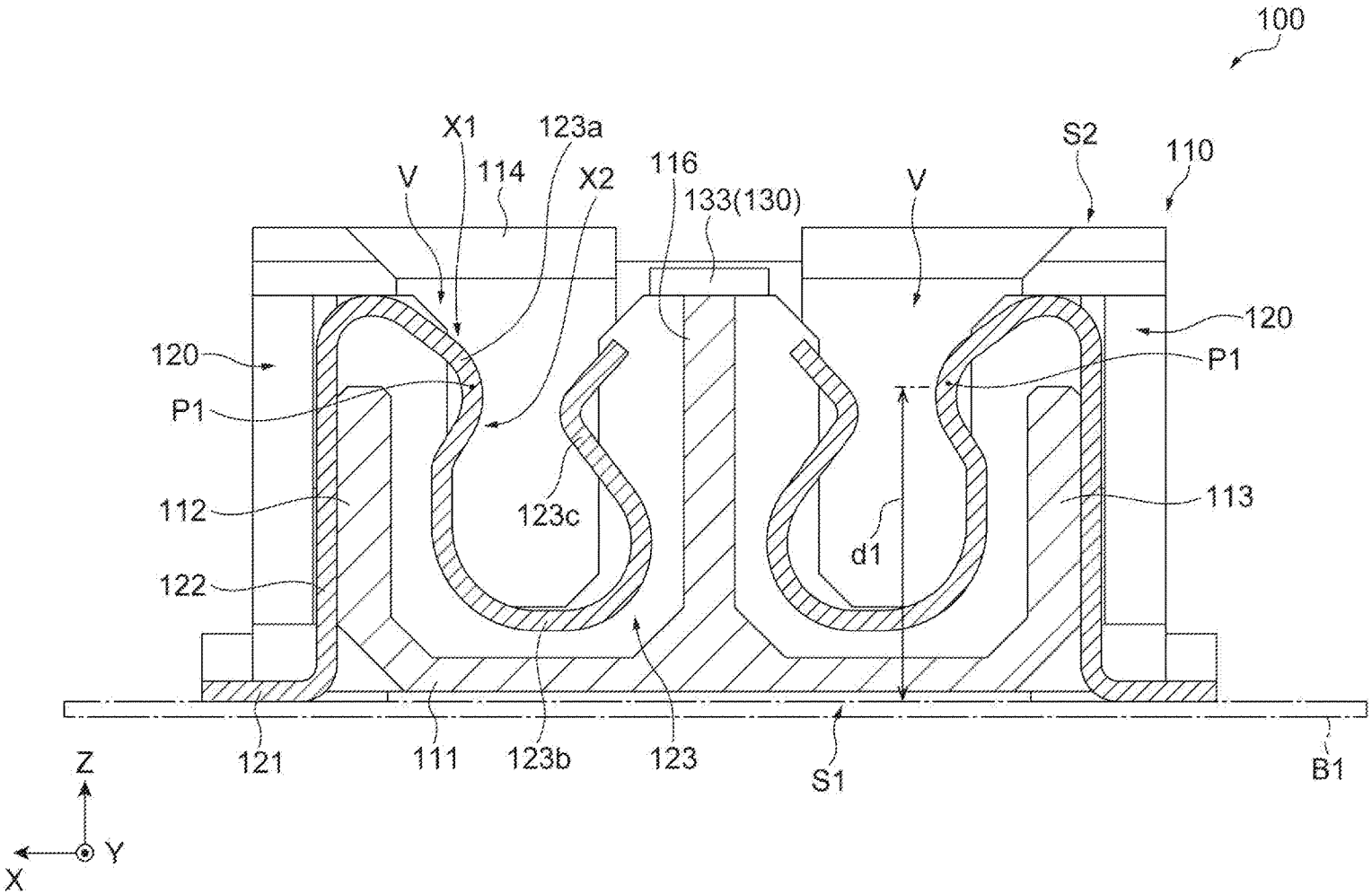
FIG. 6 is a cross-sectional view taken along line VI-VI of FIG. 5.

The following is an explanation of the receptacle connector 100, with reference to FIG. 4 to FIG. 6. The receptacle connector 100 includes a housing 110 (second insulating housing), a plurality of conductive terminals 120 (second conductive terminals), and a pair of regulating members 130 (second regulating members).

The housing 110 is formed of an insulating material, such as resin. The housing 110 has a rectangular-parallelepiped shape extending in a predetermined direction. The housing 110 includes a mounting surface S1 (second mounting surface) and an opposed surface S2 (second opposed surface) (see FIG. 5 and FIG. 6). The mounting surface S1 is opposed to the circuit board B1 and turned down on the circuit board B1, in a state where the receptacle connector 100 is mounted on the circuit board B1 by soldering or the like. The opposed surface S2 is opposed to the mounting surface S1, and positioned in the opened side of a receiving recessed portion V described later. In explanation of the receptacle connector 100, a direction in which the mounting surface S1 is opposed to the opposed surface S2 is referred to as the "Z direction" hereinafter. In explanation of the receptacle connector 100, the side of the circuit board B1 on the basis of the mounting surface S1 may be referred to as the "lower side", and the side of the opposed surface S2 on the basis of the mounting surface S1 may be referred to as the "upper side" hereinafter.

The housing 110 includes a bottom wall portion 111, sidewall portions 112 to 115, and a center wall portion 116. The bottom wall portion 111 has a plate-like member having a rectangular shape. The bottom surface of the bottom wall portion 111 forms the mounting surface S1.

Each of the sidewall portions 112 to 115 is provided on the bottom wall portion 111, in a state of standing straight from the bottom wall portion 111, or in a vertical orientation. The sidewall portions 112 and 113 (wall portions) are positioned on respective long sides of the bottom wall portion 111, and extend along the respective long sides. The sidewall portions 114 and 115 are positioned on respective short sides of the bottom wall portions 111, and extend along the respective short sides. For this reason, the sidewall portions 112 and 113 are opposed to each other, and the sidewall portions 114 and 115 are opposed to each other. In explanation of the receptacle connector 100, the direction in which the sidewall portions 112 and 113 are opposed is referred to as the "X direction", and the direction in which the sidewall portions 114 and 115 are opposed is referred to as the "Y direction".

The center wall portion 116 is provided on the bottom wall portion 111, in a state of standing straight from the bottom wall portion 111. The center wall portion 116 is positioned in a space surrounded by the sidewall portions 112 to 115, in a state of being spaced apart from the sidewall portions 112 to 115. The center wall portion 116 extends along the long sides of the bottom wall portion 111. For this reason, the center wall portion 116 is opposed to the sidewall portions 112 and 113. The receiving recessed portion V is formed within the space surrounded by the bottom wall portion 111, the sidewall portions 112 to 115, and the center wall portion 116. Accordingly, the receiving recessed portion V has a rectangular annular shape.

A plurality of conductive terminals 120 (e.g., 20 conductive terminals 120 in some example embodiments) are attached to the sidewall portion 112. The conductive terminals 120 are arranged in a line in the extending direction (Y direction) in the sidewall portion 112. In the same manner, a plurality of conductive terminals 120 (e.g., 20 conductive terminals 120) are attached to the sidewall portion 113. Because the conductive terminals 120 have the same structure, the following explanation illustrates the conductive terminals 120 in the sidewall portion 112, and explanation of the conductive terminals 120 in the sidewall portion 113 is omitted.

Each of the conductive terminals 120 is formed of a plate-like conductive material (such as a metal member). As illustrated in FIG. 6, the conductive terminal 120 includes a proximal end portion 121 (attached portion), a middle portion 122, and a contact portion 123. The proximal end portion 121 is positioned in the vicinity of the bottom wall portion 111, and extends outward in the X direction from the sidewall portion 112. The proximal end portion 121 is connected with an electrode (not illustrated) of the circuit board B1 with solder or the like, when the receptacle connector 100 is mounted on the circuit board B1. For this reason, the proximal end portion 121 functions as the attached portion attached to the circuit board B1.

The middle portion 122 extends upward from the vicinity of the mounting surface S1, in the Z direction along the sidewall portion 112. The middle portion 122 is a portion fixed by being press-fitted into a groove formed in the sidewall portion 112. The lower end portion of the middle portion 122 is integrally connected with an end portion of the proximal end portion 121 close to the sidewall portion 112.

The contact portion 123 is supported by the middle portion 122, in a cantilever manner. The contact portion 123 is positioned in the receiving recessed portion V. The contact portion 123 includes a projecting portion 123*a*, a curved portion 123*b*, and a projecting portion 123*c*.

The projecting portion 123*a* is integrally connected with the upper end portion of the middle portion 122. The projecting portion 123*a* has a mountain-like shape or convex, and projects in the X direction from the sidewall portion 112 side toward the sidewall portion 113 side (center wall portion 116 side). Specifically, the amount of projection of the projecting portion 123*a* towards the sidewall portion 113 decreases on either side of the peak P1. In other words, the amount of projection of the projecting portion 123*a* in the X direction decreases along the Z direction (vertical direction), with a maximum amount of projection occurring at the peak P1.

Specifically, the upper portion of the projecting portion 123*a* located between the peak P1 and the middle portion 122 is inclined to be close to the sidewall portion 112 as the projecting portion 123*a* extends upward (toward the opposed surface S2), as viewed from the peak P1. By contrast, the lower portion of the projecting portion 123*a* located between the peak P1 and the curved portion 123*b* is inclined to be close to the sidewall portion 112 as it extends downward (toward the mounting surface S1), as viewed from the peak P1. An initial range of contact X1 comprising one or more initial points of contact between opposing projecting portions is located on a first, upper side of the peak P1. When fitting the first connector to the second connector, a first projecting portion associated with peak P1 is configured to provide a second projecting portion associated with peak P3 with a first elastic force acting in a first direction associated with disengaging the first and second insulating housings from each other. The first elastic force results from contact between the first projecting portion and the second projecting portion along the initial range of contact X1. Additionally, a subsequent range of contact X2 comprising one or more subsequent points of contact between opposing projecting portions is located on a second, lower side of the peak P1. The first projecting portion associated with peak P1 is configured to provide the second projecting portion with a second elastic force acting in a second direction associated with engaging the first and second insulating housings to each other. The second elastic force results from contact between the first projecting portion and the second projecting portion along the subsequent range of contact X2. Although the elastic forces provided by the projecting portion is described with reference to FIG. 6, one of skill in the art would appreciate that a similar description may apply to projecting portions associated with either of the regulating members or the conductive terminals, as further described throughout this specification.

The curved portion 123*b* has a substantially U shape that extends downward from the vicinity of the opposed surface S2 and is bent upward in the vicinity of the mounting surface S1. The projecting portion 123*c* has a mountain-like shape in the same manner as the projecting portion 123*a*, and projects from the sidewall portion 113 toward the sidewall portion 112.

As illustrated in FIG. 4 and FIG. 5, one of a pair of regulating members 130 is attached to the sidewall portion 114. In the same manner, the other of the regulating members 130 is attached to the sidewall portion 115. Specifically, the pair of regulating members 130 are arranged to interpose the conductive terminals 120 therebetween, in the direction (e.g., Y direction) in which the conductive terminals 120 are arranged. Because the regulating members 130 have the same structure, the following explanation illustrates the regulating member 130 in the sidewall portion 114, and an explanation of the regulating member 130 in the sidewall portion 115 is omitted.

The regulating member 130 is formed of a plate-like conductive material (for example, a metal member). As illustrated in FIG. 5, the regulating member 130 includes a pair of proximal end portions 131 (attached portions), a middle portion 132, and a contact portion 133. As illustrated in FIG. 4, the proximal end portions 131 forming a pair are positioned adjacent to the mounting surface S1, and positioned on both sides of the sidewall portion 114 in the X direction. The proximal end portions 131 extend upward from the vicinity of the mounting surface S1. The proximal end portions 131 are press-fitted into a slit 114*a* provided in the sidewall portion 114, and fixed to the housing 110. Lower ends of the proximal end portions 131 are connected with an electrode (not illustrated) of the circuit board B1 with solder or the like, in a state where the receptacle connector 100 is mounted on the circuit board B1. For this reason, the proximal end portions 131 function as attached portions attached to the circuit board B1.

The middle portion 132 is located between the proximal end portions 131 in the X direction. An upper end portion of the middle portion 132 is integrally connected with upper end portions of the proximal end portions 131. The middle portion 132 extends in a vertical direction (Z direction) along the sidewall portion 114.

The contact portion 133 is supported by the middle portion 132, in a cantilever manner. Part of the contact portion 133 is positioned in the receiving recessed portion V. The contact portion 133 includes a curved portion 133*a* and a projecting portion 133*b*. The curved portion 133*a* has a substantially U shape that extends downward from the vicinity of the opposed surface S2 and is bent upward in the vicinity of the mounting surface S1. One end portion (lower end portion) of the curved portion 133*a* is integrally connected with the lower end portion of the middle portion 132. The curved portion 133*a* extends along the Z direction (vertical direction). The upper end portion of the curved portion 133*a* is opposed to the center wall portion 116.

The projecting portion 133*b* has a mountain-like shape, and projects from the sidewall portion 114 side toward the sidewall portion 115 side (center wall portion 116 side) in a similar manner as described above with respect to projecting portion 123*a*. Specifically, amount of projection of the projecting portion 133*b* decreases on either side of the peak P2. In other words, the amount of projection of the projecting portion 133*b* in the Y direction decreases along the Z direction (vertical direction), with a maximum amount of projection occurring at the peak P2.

Specifically, the lower portion (the portion between the peak P2 and the curved portion 133*a*) of the projecting portion 133*b* located below the peak P2 is inclined to be close to the sidewall portion 114 as it extends downward (toward the mounting surface S1), as viewed from the peak P2. By contrast, the upper portion of the projecting portion 133*b* (opposed surface S2 side) located above the peak P2 is inclined to be close to the sidewall portion 114 as it extends upward (toward the opposed surface S2), as viewed from the peak P2.

As illustrated in FIG. 5 and FIG. 6, $d1<d2$ is satisfied, when parameters d1 and d2 are defined as follows:

d1: the height in the Z direction from the surface of the circuit board B1 to the peak P1 of the projecting portion 123*a* of the conductive terminal 120; and d2: the height in the Z direction from the surface of the circuit board B1 to the peak P2 of the projecting portion 133*b* of the regulating portion 130.

Specifically, the peak P2 is positioned higher (on the opposed surface S2 side) than the peak P1.

Structure of Plug Connector

Figure 7:
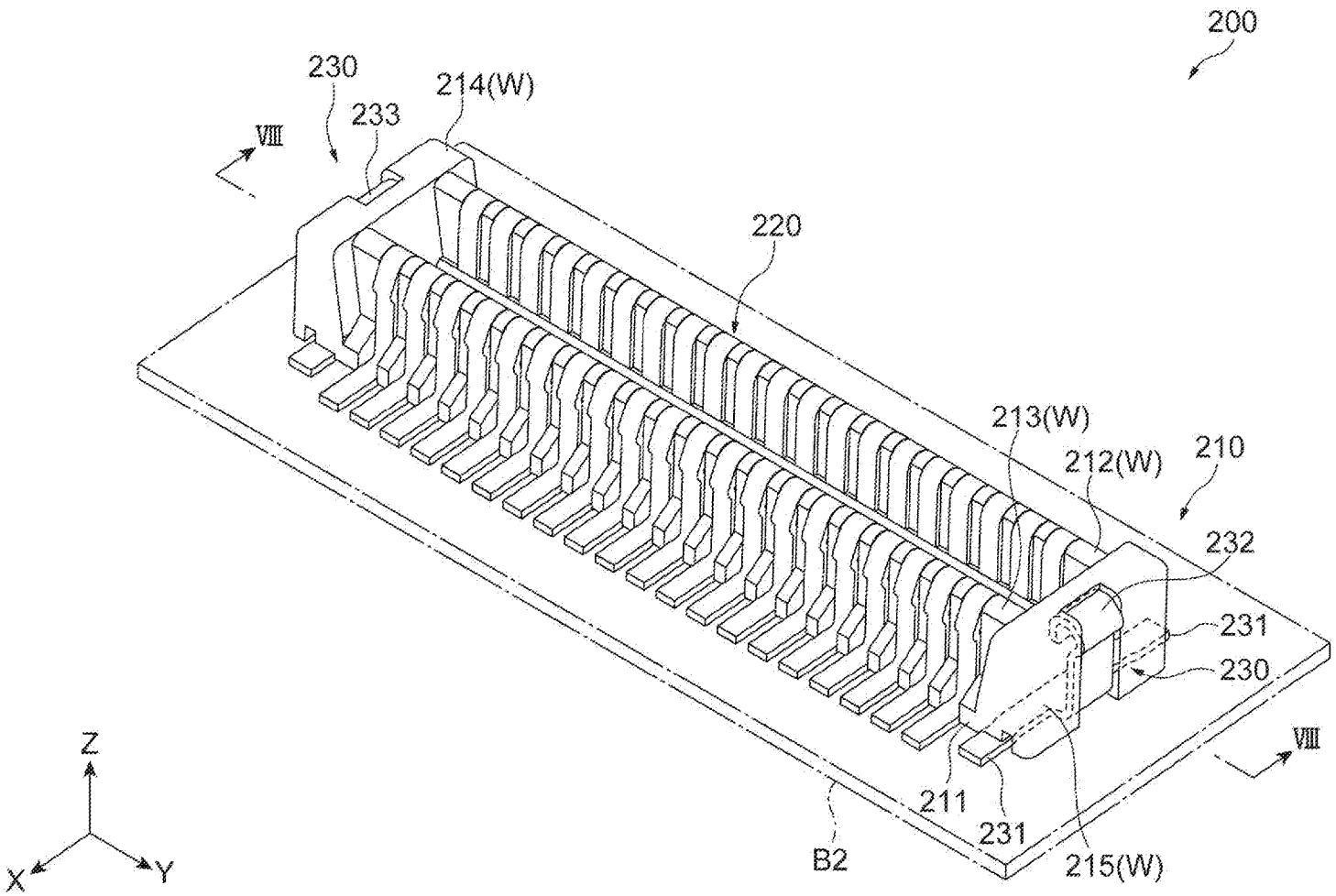
FIG. 7 is a cross-sectional view illustrating a plug connector forming the connector device of FIG. 1.
Figure 8:
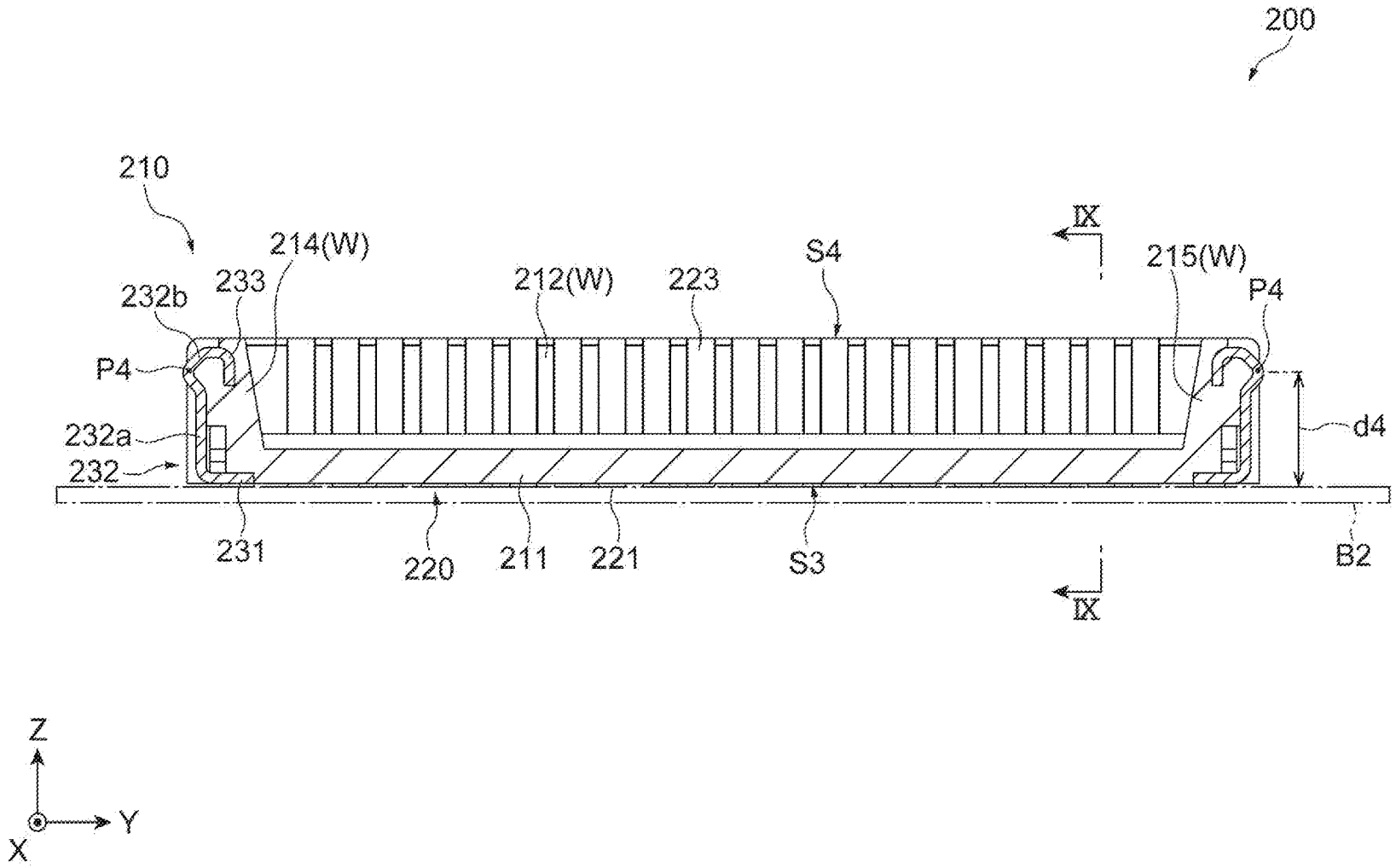
FIG. 8 is a cross-sectional view taken along line VIII-VIII of FIG. 7.
Figure 9:
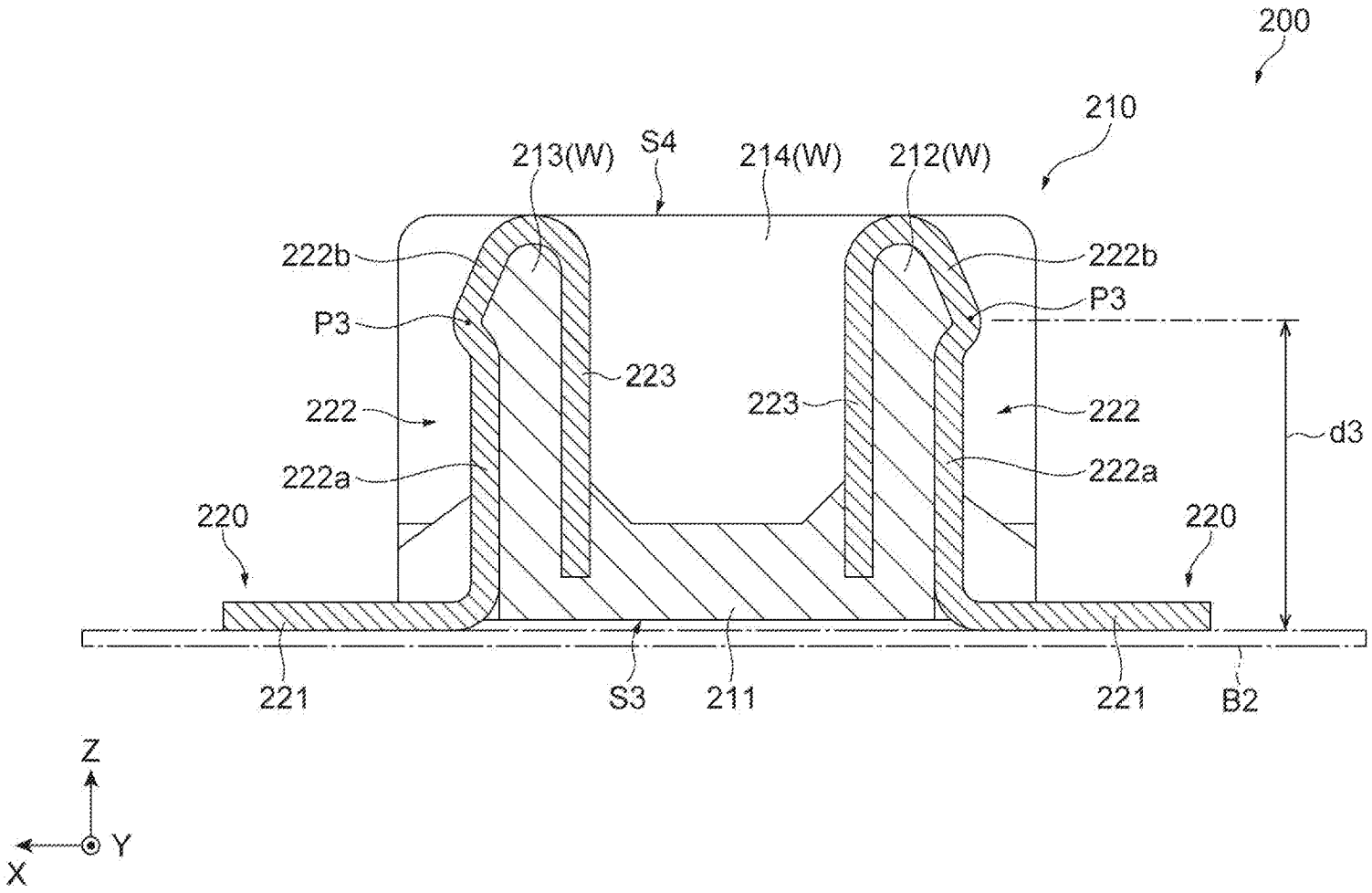
FIG. 9 is a cross-sectional view taken along line IX-IX of FIG. 8.

The following is explanation of the plug connector 200, with reference to FIG. 7 to FIG. 9. The plug connector 200 includes a housing 210 (first insulating housing), a plurality of conductive terminals 220 (first conductive terminals), and a pair of regulating members 230 (first regulating members).

The housing 210 is formed of an insulating material such as resin. The housing 210 has a rectangular-parallelepiped shape extending in a predetermined direction. As shown in FIG. 8 and FIG. 9, the housing 210 includes a mounting surface S3 (first mounting surface) and an opposed surface S4 (first opposed surface). The mounting surface S3 is opposed to the circuit board B2 and turned down on the circuit board B2, in a state where the plug connector 200 is mounted on the circuit board B2 by soldering or the like. The opposed surface S4 is opposed to the mounting surface S3, and positioned in a distal end side of a fitting projecting portion W described later. In explanation of the plug connector 200, a direction in which the mounting surface S3 is opposed to the opposed surface S4 is referred to as the "Z direction" hereinafter. In explanation of the plug connector 200, the side of the circuit board B2 on the basis of the mounting surface S3 may be referred to as the "lower side", and the side of the opposed surface S4 on the basis of the mounting surface S3 may be referred to as the "upper side" hereinafter.

The housing 210 includes a bottom wall portion 211, and sidewall portions 212 to 215. The bottom wall portion 211 has a plate-like member having a rectangular shape. The bottom surface of the bottom wall portion 211 forms the mounting surface S3.

Each of the sidewall portions 212 to 215 is provided on the bottom wall portion 211, in a state of standing straight from the bottom wall portion 211. The sidewall portions 212 to 215 are received in the receiving recessed portion V of the receptacle connector 100, when the plug connector 200 is fitted with the receptacle connector 100. For this reason, the sidewall portions 212 to 215 form the fitting projecting portion W, as a whole.

The sidewall portions 212 and 213 (wall portions) are positioned on respective long sides of the bottom wall portion 211, and extend along the respective long sides. The sidewall portions 214 and 215 are positioned on respective short sides of the bottom wall portions 211, and extend along the respective short sides. For this reason, the sidewall portions 212 and 213 are opposed to each other, and the sidewall portions 214 and 215 are opposed to each other. Accordingly, the fitting projecting portion W has a rectangular tube shape. The center wall portion 116 of the receptacle connector 100 is received in the internal space of the fitting projecting portion W having a rectangular tube shape, when the plug connector 200 is fitted with the receptacle connector 100. In explanation of the plug connector 200, the direction in which the sidewall portions 212 and 213 are opposed is referred to as the "X direction", and the direction in which the sidewall portions 214 and 215 are opposed is referred to as the "Y direction".

A plurality of conductive terminals 220 (e.g., 20 conductive terminals 220) are attached to the sidewall portion 212. The conductive terminals 220 are arranged in a line in the extending direction (Y direction) in the sidewall portion 212. In the same manner, a plurality of conductive terminals 220 (e.g., 20 conductive terminals 220) are attached to the sidewall portion 213. Because the conductive terminals 220 have the same structure, the following explanation illustrates the conductive terminals 220 in the sidewall portion 212, and explanation of the conductive terminals 220 in the sidewall portion 213 is omitted.

Each of the conductive terminals 220 is formed of a plate-like conductive material (such as a metal member). As illustrated in FIG. 9, the conductive terminal 220 includes a proximal end portion 221 (attached portion), a contact portion 222, and a fixed portion 223. The proximal end portion 221 is positioned in the vicinity of the bottom wall portion 211, and extends outward in the X direction from the sidewall portion 212. The proximal end portion 221 is connected with an electrode (not illustrated) of the circuit board B2 with solder or the like, when the plug connector 200 is mounted on the circuit board B2. For this reason, the proximal end portion 221 functions as the attached portion attached to the circuit board B2.

The contact portion 222 extends in the Z direction along the external surface of the sidewall portion 212. The contact portion 222 includes a flat portion 222*a*, and a projecting portion 222*b*. The flat portion 222*a* has a straight-line shape. The lower end portion of the flat portion 222*a* is integrally connected with an end portion of the proximal end portion 221 close to the sidewall portion 212.

The projecting portion 222*b* is integrally connected with the upper end portion of the flat portion 222*a*. The projecting portion 222*b* has a mountain-like shape, and projects outward in the X direction from the sidewall portion 212. Specifically, the amount of projection of the projecting portion 222*b* decreases on either side of the peak P3. In other words, the amount of projection of the projecting portion 222*b* in the X direction decreases along the Z direction (vertical direction), with a maximum amount of projection occurring at the peak P3.

Specifically, the lower portion (the portion between the peak P3 and the flat portion 222*a*) of the projecting portion 222*b* located below the peak P3 is inclined to be close to the sidewall portion 212 as it extends downward (toward the mounting surface S3), as viewed from the peak P3. By contrast, the upper portion (the portion on the opposed surface S4 side beyond the peak P3) of the projecting portion 222*b* located above the peak P3 is inclined to be close to the sidewall portion 212 as it extends upward (toward the opposed surface S4), as viewed from the peak P3.

The fixed portion 223 extends in the Z direction along the internal wall surface of the sidewall portion 212. The upper end portion of the fixed portion 223 is integrally connected with the upper end portion of the projecting portion 222*b*, and has a substantially U shape that extends upward from the vicinity of the mounted surface S3 and is bent downward in the vicinity of the opposed surface S4. The lower end portion of the fixed portion 223 is fixed in the sidewall portion 212.

As illustrated in FIG. 7 and FIG. 8, one of the regulating members 230 is attached to the sidewall portion 214. In the same manner, the other one of the regulating members 230 is attached to the sidewall portion 215. Specifically, the regulating members 230 are positioned to interpose the conductive terminals 220 therebetween in the direction (e.g., the Y direction) in which the conductive terminals 220 are arranged. Because the regulating members 230 have the same structure, the following explanation illustrates the regulating member 230 in the sidewall portion 214, and explanation of the regulating member 230 in the sidewall portion 215 is omitted.

The regulating member 230 is formed of a plate-like conductive material (such as a metal material). As illustrated in FIG. 8, the regulating member 230 includes a proximal end portion 231 (attached portion), a contact portion 232, and a fixed portion 233. As illustrated in FIG. 7, the proximal end portion 231 is positioned on the bottom surface of the bottom wall portion 211, and extends in the X direction so that the proximal end portion 231 is positioned on both sides of the sidewall portion 214. The proximal end portion 231 is connected to an electrode (not illustrated) of the circuit board B2 with solder or the like, when the plug connector 200 is mounted on the circuit board B2. For this reason, the proximal end portion 231 functions as the attached portion attached to the circuit board B2.

The contact portion 232 extends in the Z direction along the external surface of the sidewall portion 214. The contact portion 232 includes a flat portion 232*a* and a projecting portion 232*b*. The flat portion 232*a* has a straight-line shape. The lower end portion of the flat portion 232*a* is integrally connected with a side edge of the proximal end portion 231 close to the sidewall portion 214.

The projecting portion 232*b* is integrally connected with the upper end portion of the flat portion 232*a*. The projecting portion 232*b* has a mountain-like shape, and projects outward in the Y direction from the sidewall portion 214. Specifically, the amount of projection the projecting portion 232*b* decreases on either side of the peak P4. In other words, the amount of projection of the projecting portion 232*b* in the Y direction decreases along the Z direction (vertical direction), with a maximum amount of projection occurring at the peak P4.

Specifically, the lower portion (the portion between the peak P4 and the flat portion 232*a*) of the projecting portion 232*b* located below the peak P4 is inclined to be close to the sidewall portion 214 as it extends downward (toward the mounting surface S3), as viewed from the peak P4. By contrast, the upper portion of the projecting portion 232*b* located above the peak P4 is inclined to be close to the sidewall portion 214 as it extends upward (toward the opposed surface S4), as viewed from the peak P4.

The fixed portion 233 has an L shape. One end portion of the fixed portion 233 is integrally connected with the upper end portion of the projecting portion 232*b*. The other end portion of the fixed portion 233 is fixed in the sidewall portion 214.

As illustrated in FIG. 8 and FIG. 9, d3>d4 is satisfied, when parameters d3 and d4 are defined as follows:

d3: the height in the Z direction from the surface of the circuit board B2 to the peak P3 of the projecting portion 222*b* of the conductive terminal 220; and d4: the height in the Z direction from the surface of the circuit board B2 to the peak P4 of the projecting portion 232*b* of the regulating portion 230.

Specifically, the peak P3 is positioned higher (on the opposed surface S4 side) than the peak P4.

Details of Connector Device

The following is more detailed explanation of the structure of the connector device 1 formed by fitting the receptacle connector 100 with the plug connector 200, with reference to FIG. 1 to FIG. 3. Although the following explanation illustrates the relation between the conductive terminals 120 in the sidewall portion 112 and the conductive terminals 220 in the sidewall portion 212, the relation between the conductive terminals 120 in the sidewall portion 113 and the conductive terminals 220 in the sidewall portion 213 is also the same, and an explanation thereof is omitted. Although the following explanation also illustrates the relation between the regulating member 130 in the sidewall portion 114 and the regulating member 230 in the sidewall portion 214, the relation between the regulating member 130 in the sidewall portion 115 and the regulating member 230 in the sidewall portion 215 is also the same, and an explanation thereof is omitted. In addition, in explanation of the connector device 1, the side of the circuit board B1 on the basis of the mounting surface S1 is referred to as the "lower side", and the side of the opposed surface S2 on the basis of the mounting surface S1 may be referred to as the "upper side" hereinafter, for the sake of convenience.

In the state (fitted state) in which the receptacle connector 100 is fitted with the plug connector 200, the fitting projecting portion W of the housing 210 is received in the receiving recessed portion V of the housing 110. Specifically, the sidewall portion 212 is positioned between the sidewall portion 112 and the center wall portion 116. The sidewall portion 213 is positioned between the sidewall portion 113 and the center wall portion 116. The sidewall portion 214 is positioned between the sidewall portion 114 and the center wall portion 116. The sidewall portion 215 is positioned between the sidewall portion 115 and the center wall portion 116.

In the fitted state, as illustrated in FIG. 3, the contact portion 222 and the fixed portion 223 are inserted into the contact portion 123, together with the sidewall portion 212. When the contact portion 222 and the fixed portion 223 are inserted into the contact portion 123, the contact portion 123 is expanded in the X direction with the contact portion 222, the fixed portion 223, and the sidewall portion 212. For this reason, the elastic force of the contact portion 123 that is configured to return to its original shape acts on the contact portion 222 and the fixed portion 223, the projecting portion 123*a* contacts the contact portion 222 (flat portion 222*a*), and the projecting portion 123*c* contacts the fixed portion 223. Specifically, the contact portion 222, the fixed portion 223, and the sidewall portion 212 are sandwiched with the contact portion 123. In this state, the upper end portion of the middle portion 122 integrally connected with the projecting portion 123*a* is also deformed to bulge outward in the X direction.

In the fitted state, as illustrated in FIG. 2, the contact portion 232 and the sidewall portion 214 presses the contact portion 133 of the regulating member 130 outward in the Y direction. For this reason, the elastic force of the contact portion 133 that is configured to return to its original shape acts on the contact portion 232 and the sidewall portion 214, and the projecting portion 133*b* abuts against the contact portion 232 (flat portion 232*a*). Specifically, the plug connector 200 is held between the regulating member 130 in the sidewall portion 114 and the regulating member 130 in the sidewall portion 115. In this state, the lower end portion of the middle portion 132 integrally connected with the projecting portion 133*b* is also deformed to bulge outward in the Y direction.

As illustrated in FIG. 3, in the fitted state, the projecting portion 123*a* in the conductive terminal 120 projects toward the contact portion 222 of the conductive terminal 220 and the center wall portion 116. In the same manner, the projecting portion 222*b* in the conductive terminal 220 projects toward the projecting portion 123*a* and the sidewall portion 112, in the fitted state.

As illustrated in FIG. 2, in the fitted state, the projecting portion 133*b* in the regulating member 130 projects toward the contact portion 232 in the regulating member 230 and the sidewall portion 214. In the same manner, the projecting portion 232*b* in the regulating member 230 projects toward the contact portion 133 in the regulating member 130 and the sidewall portion 114, in the fitted state.

Method for Assembling Connector Device

The following is an explanation of a method for assembling (producing) the connector device 1, with reference to FIG. 10A to FIG. 14B. Because the connector device 1 is formed by fitting the receptacle connector 100 with the plug connector 200, specifically, the process of fitting the receptacle connector 100 with the plug connector 200 will be explained. In explanation of the fitting process, as illustrated in FIG. 10A to FIG. 14B, the side of the circuit board B1 on the basis of the mounting surface S1 is referred to as the "lower side", and the side of the opposed surface S2 on the basis of the mounting surface S1 is referred to as the "upper side".

The process of fitting the conductive terminals 120 in the sidewall portion 112 with the conductive terminals 220 in the sidewall portion 212 is similar to the process of fitting the conductive terminals 120 in the sidewall portion 113 with the conductive terminals 220 in the sidewall portion 213. For this reason, the following explanation illustrates the former, and explanation of the latter is omitted. In addition, the process of fitting the regulating member 130 in the sidewall portion 114 with the regulating member 230 in the sidewall portion 214 is similar to the process of fitting the regulating member 130 in the sidewall portion 115 with the regulating member 230 in the sidewall portion 215. For this reason, the following explanation illustrates the former, and explanation of the latter is omitted.

(1) Placed State

Figure 10A:
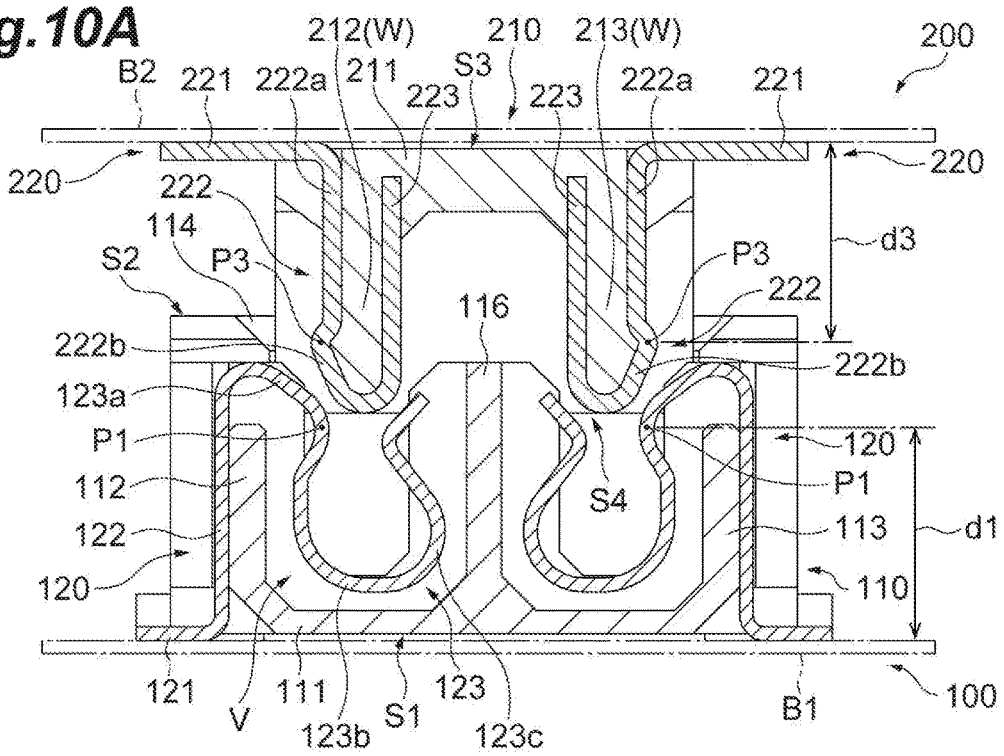
FIG. 10A is a cross-sectional view for explaining a placed state in a process in which terminals of the connectors according to the first example are fitted.
Figure 10B:
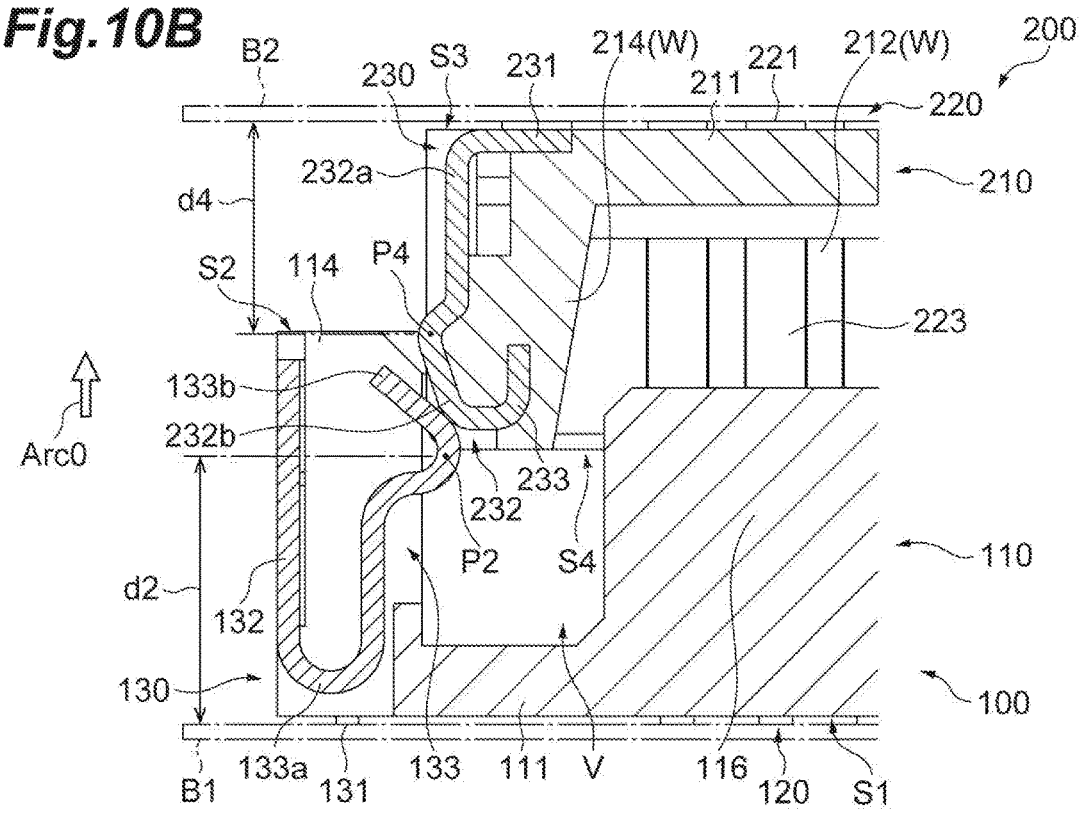
FIG. 10B is a cross-sectional view for explaining a placed state in a process in which regulating members of the connectors according to the first example are fitted.

First, as illustrated in FIG. 10A and FIG. 10B, the plug connector 200 is placed on the receptacle connector 100 such that the conductive terminals 120 and 220 are opposed to each other, the regulating members 130 and 230 are opposed to each other, the opposed surfaces S2 and S4 are opposed to each other, and the receiving recessed portion V and the fitting projecting portion W are opposed to each other. The state in which the plug connector 200 is placed on the receptacle connector 100 and no external force is applied to the connectors 100 and 200 is referred to as the "placed state".

In the placed state, as illustrated in FIG. 10B, the upper inclined surface of the projecting portion 133*b* (the opposed surface S2 side) located above the peak P2 abuts against the lower inclined surface of the projecting portion 232*b* (the opposed surface S4 side) located below the peak P4. For this reason, the projecting portion 133*b* provides the projecting portion 232*b* with its reaction force, while receiving the weight of the plug connector 200. Accordingly, the regulating member 130 provides the projecting portion 232*b* with elastic force Arc0 (first elastic force) acting in a direction (separating direction) in which the plug connector 200 separates from the receptacle connector 100.

By contrast, in the placed state, as illustrated in FIG. 10A, the projecting portion 123*a* of the conductive terminal 120 does not abut against the projecting portion 222*b* of the conductive terminal 220. For this reason, the conductive terminal 120 is not electrically connected with the conductive terminal 220.

(2) First Pressed State

Figure 11A:
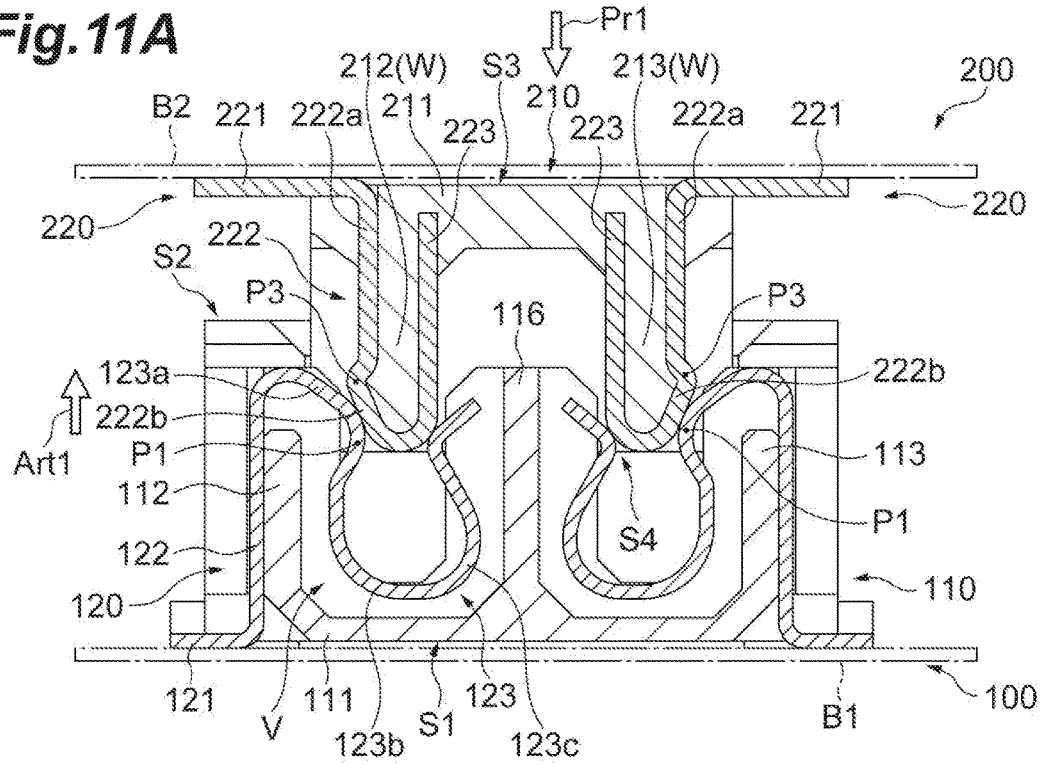
FIG. 11A is a cross-sectional view for explaining a first pressed state in the process in which the terminals of the connectors according to the first example are fitted.
Figure 11B:
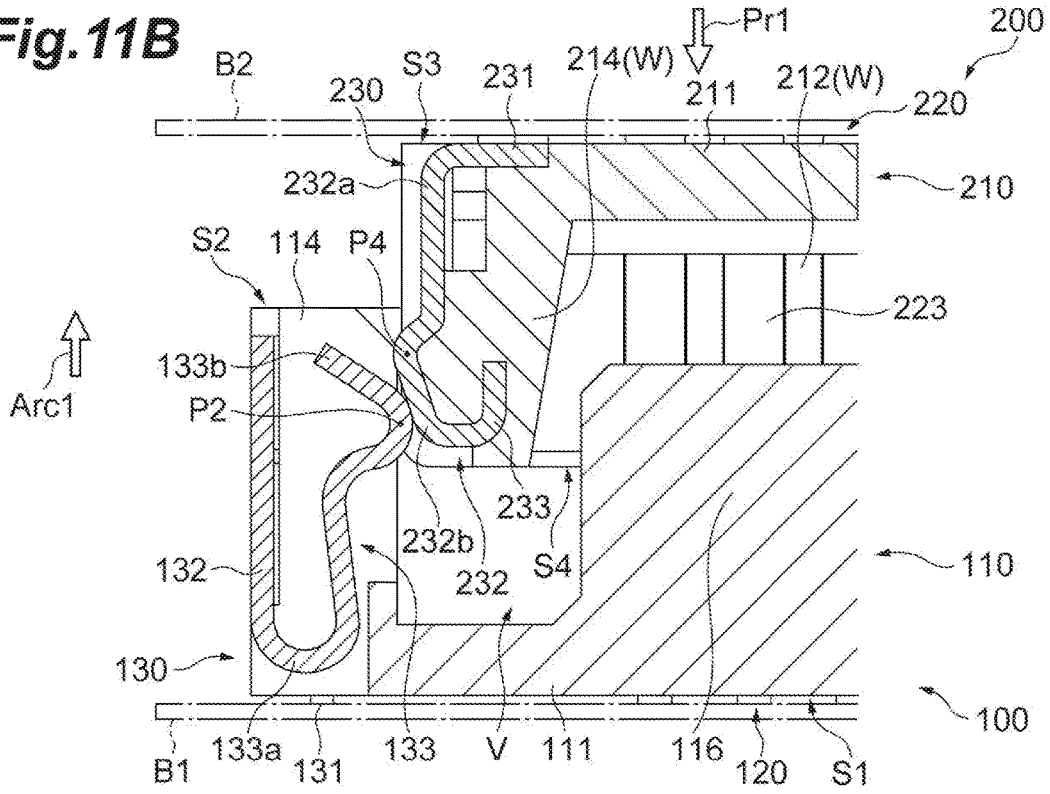
FIG. 11B is a cross-sectional view for explaining a first pressed state in the process in which the regulating members of the connectors according to the first example are fitted.

Thereafter, as illustrated in FIG. 11A and FIG. 11B, pressure Pr1 is applied to the plug connector 200 in the placed state, to push the plug connector 200 into the receptacle connector 100. For this reason, the plug connector 200 moves to a position lower than its position in the placed state. In this state, as illustrated in FIG. 11B, the peak P4 of the projecting portion 232*b* is positioned higher than the peak P2 of the projecting portion 133*b*. This state is referred to as the "first pressed state". In the first pressed state, in the same manner as the placed state, the projecting portion 232*b* is provided with elastic force Arc1 acting in the separating direction, from the regulating member 130.

By contrast, in the first pressed state, as illustrated in FIG. 11A, the upper inclined surface of the projecting portion 123*a* of the conductive terminal 120 (opposed surface S2 side) located above the peak P1 abuts against the lower inclined surface of the projecting portion 222*b* of the conductive terminal 220 (opposed surface S4 side) located below the peak P3. In this state, the projecting portion 123*a* provides the projecting portion 222*b* with its reaction force, while receiving the weight of the plug connector 200 and the pressure Pr1. In this manner, the conductive terminal 120 provides the projecting portion 232*b* with elastic force Art1 (third elastic force) acting in a direction (separating direction) which the plug connector 200 separates from the receptacle connector 100. Accordingly, when the pressure Pr1 is removed at this point in time, the plug connector 200 is returned to the placed state, in response to the elastic forces Arc1 (see FIG. 11B) and Art1. Specifically, the conductive terminal 120 and the conductive terminal 220 are returned to the electrically non-connected state from the electrically connected state.

(3) Second Pressed State

Figure 12A:
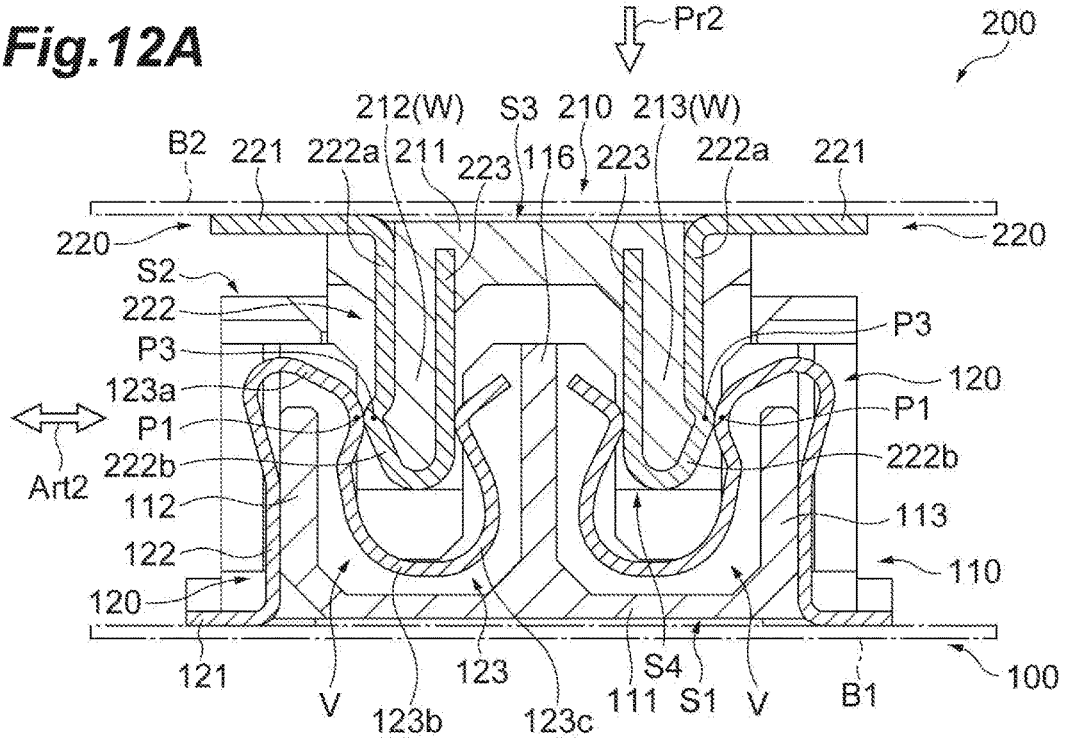
FIG. 12A is a cross-sectional view for explaining a second pressed state in the process in which the terminals of the connectors according to the first example are fitted.
Figure 12B:
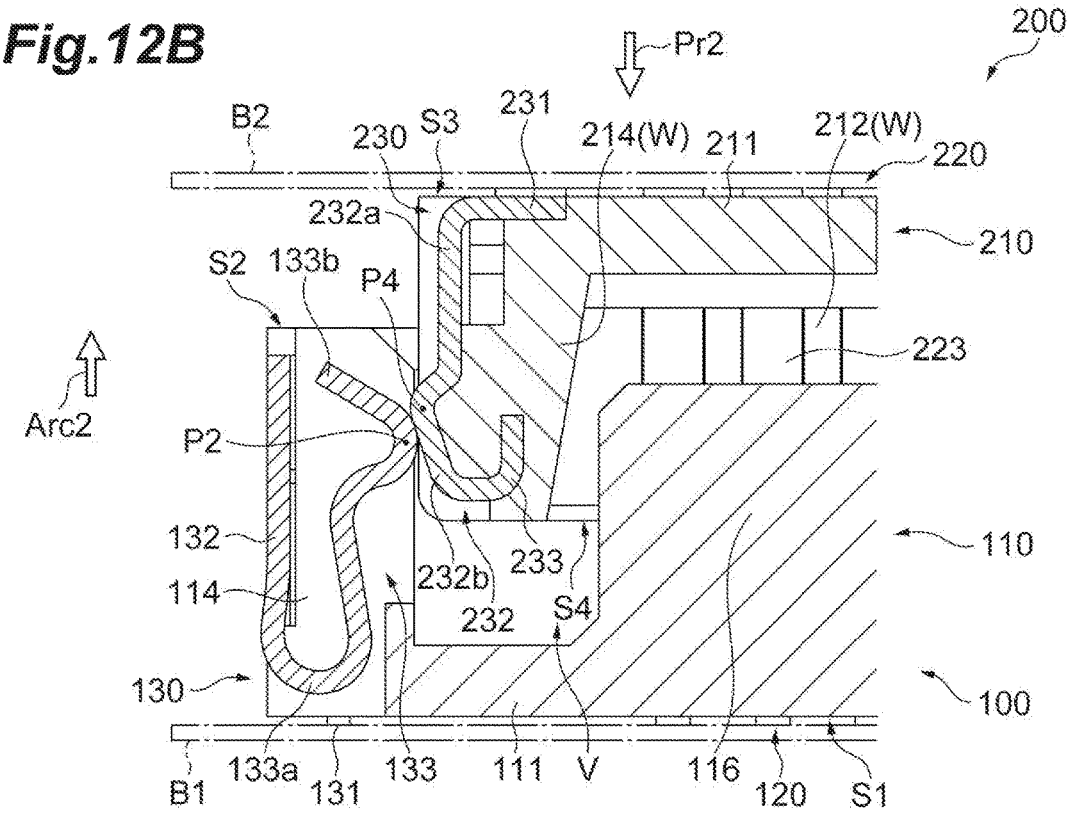
FIG. 12B is a cross-sectional view for explaining a second pressed state in the process in which the regulating members of the connectors according to the first example are fitted.

Thereafter, as illustrated in FIG. 12A and FIG. 12B, pressure Pr2 is applied to the plug connector 200 in the first pressed state, to further push the plug connector 200 into the receptacle connector 100. For this reason, the plug connector 200 moves to a position that is lower than its position in the first pressed state. In this state, as illustrated in FIG. 12B, the peak P4 of the projecting portion 232*b* is positioned above the peak P2 of the projecting portion 133*b*. This state is referred to as the "second pressed state". In the second pressed state, the projecting portion 232*b* is provided with elastic force Arc2 acting in the separating direction, from the regulating member 130.

By contrast, in the second pressed state, as illustrated in FIG. 12A, the peak P3 of the projecting portion 222*b* is in a position substantially as high as the position of the peak P1 of the projecting portion 123*a*. In this state, force in the horizontal direction acts on the peak P3 of the projecting portion 222*b* and the peak P1 of the projecting portion 123*a*, with elastic force Art2 of the contact portion 123 of the conductive terminal 120. For this reason, the conductive terminal 120 applies no elastic force in a direction in which the connectors 100 and 200 separate from each other or move toward each other, to the projecting portion 222*b*. Accordingly, when the pressure Pr2 is removed at this point in time, the plug connector 200 is returned to the placed state, in response to the elastic forces Arc2 (see FIG. 12B). Specifically, the conductive terminal 120 and the conductive terminal 220 are returned to the electrically non-connected state from the electrically connected state.

(4) Third Pressed State

Figure 13A:
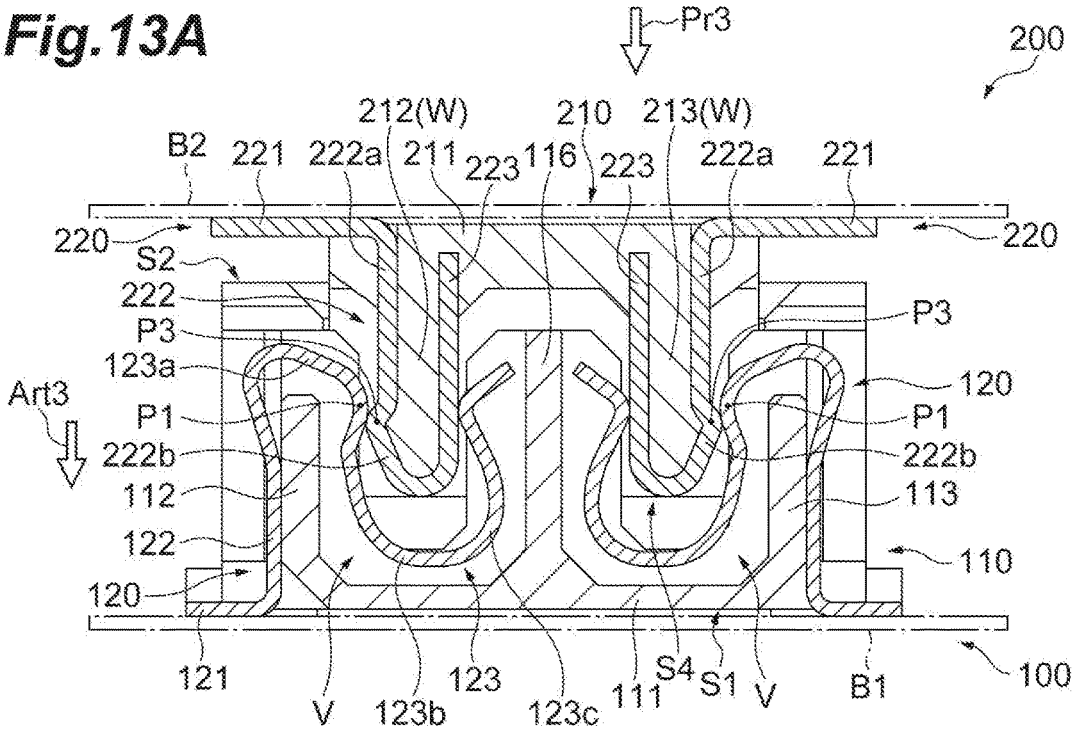
FIG. 13A is a cross-sectional view for explaining a third pressed state in the process in which the terminals of the connectors according to the first example are fitted.
Figure 13B:
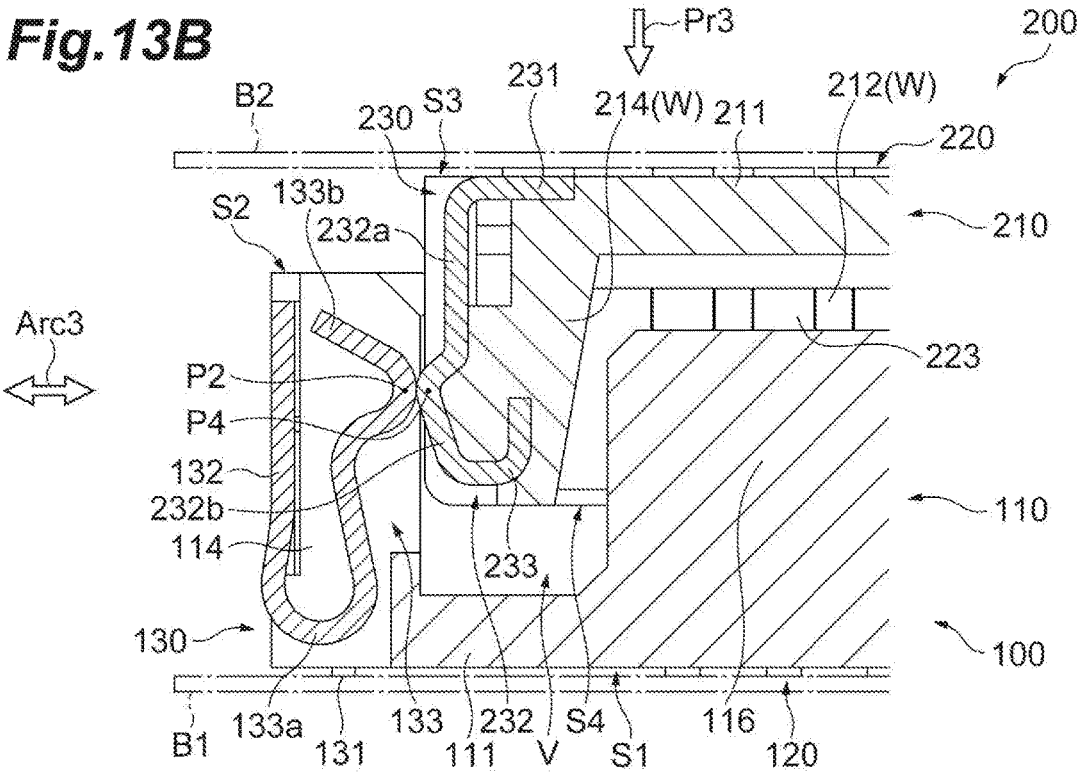
FIG. 13B is a cross-sectional view for explaining a third pressed state in the process in which the regulating members of the connectors according to the first example are fitted.

Thereafter, as illustrated in FIG. 13A and FIG. 13B, pressure Pr3 is applied to the plug connector 200 in the second pressed state, to further push the plug connector 200 into the receptacle connector 100. For this reason, the plug connector 200 moves to a position that is lower than its position in the second pressed state. In this state, as illustrated in FIG. 13B, the peak P4 of the projecting portion 232*b* is positioned substantially as high as the peak P2 of the projecting portion 133*b*. This state is referred to as the "third pressed state". In the third pressed state, force in the horizontal direction acts on the peak P2 of the projecting portion 133*b* and the peak P4 of the projecting portion 232*b*, with elastic force Arc3 of the contact portion 133 of the regulating member 130. For this reason, the regulating member 130 applies no elastic force in a direction in which the connectors 100 and 200 separate from each other or move close to each other, to the projecting portion 232*b*.

By contrast, in the third pressed state, as illustrated in FIG. 13A, the lower inclined surface of the projecting portion 123*a* (mounting surface S1 side) located below the peak P1 abuts against the upper inclined surface of the projecting portion 222*b* (mounting surface S3 side) located above the peak P3. The projecting portion 222*b* moves downward while pushing the projecting portion 123*a* outward, in response to the elastic force of the contact portion 123 of the conductive terminal 120. For this reason, the projecting portion 123*a* reduces the horizontal displacement amount caused by the projecting portion 222*b* and provides the projecting portion 222*b* with a reaction force that operates to return the conductive terminal 120 to its original shape. Accordingly, the conductive terminal 120 provides the projecting portion 222*b* with elastic force Art3 (fourth elastic force) acting in a direction (close direction) in which the plug connector 200 comes close to the receptacle connector 100. For this reason, the plug connector 200 is pulled into the receptacle connector 100 with the elastic force Art3.

Figure 14A:
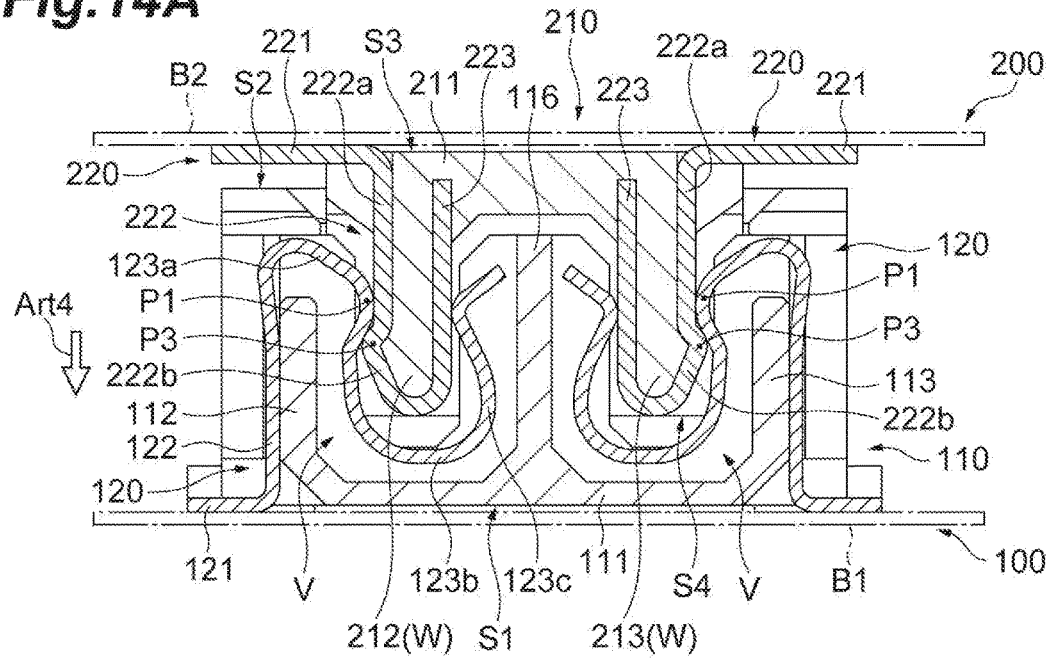
FIG. 14A is a cross-sectional view for explaining a fitted state in the process in which the terminals of the connectors according to the first example are fitted.
Figure 14B:
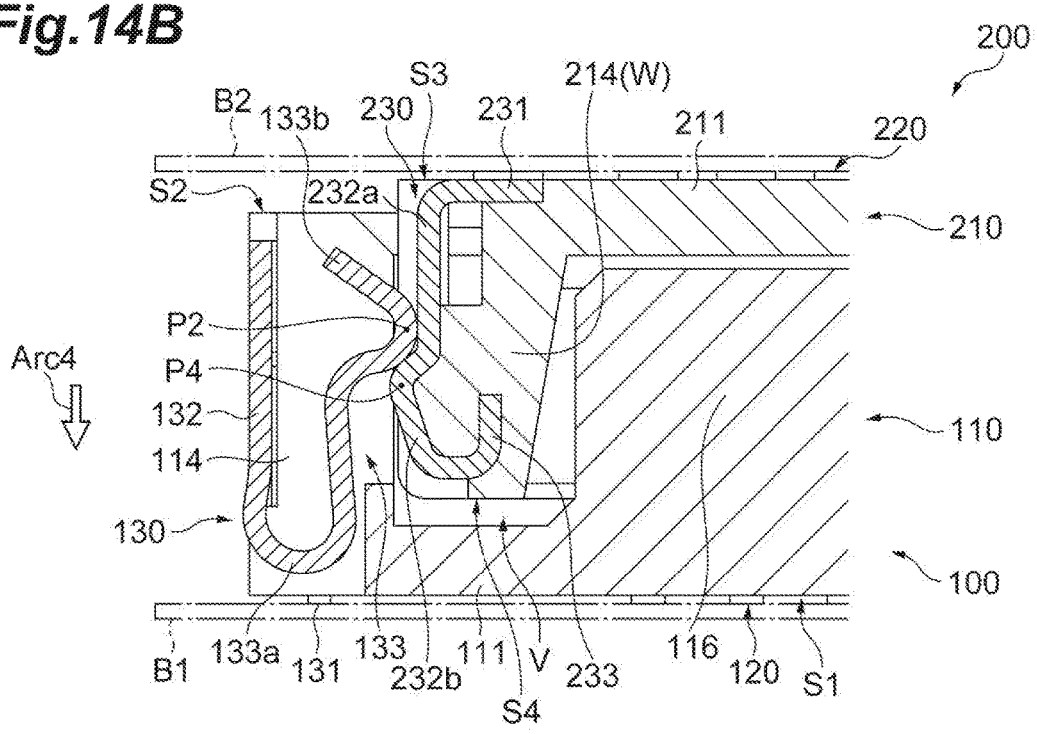
FIG. 14B is a cross-sectional view for explaining a fitted state in the process in which the regulating members of the connectors according to the first example are fitted.

When the plug connector 200 is pulled into the receptacle connector 100, as illustrated in FIG. 14B, the lower inclined surface of the projecting portion 133*b* (mounting surface S1 side) located below the peak P2 abuts against the upper inclined surface of the projecting portion 232*b* (mounting surface S3 side) located above the peak P4. Because the projecting portion 232*b* moves downward while pushing the projecting portion 133*b* outward, the projecting portion 133*b* provides the projecting portion 232*b* with a reaction force that operates to return the regulating member 130 to its original shape. Accordingly, the regulating member 130 provides projecting portion 232*b* with elastic force Arc4 (second elastic force) acting in a direction (close direction) while the plug connector 200 comes close to the receptacle connector 100. In this state, as illustrated in FIG. 14A, the conductive terminal 120 also provides the projecting portion 222*b* with elastic force Art4 acting in the close direction. For this reason, the plug connector 200 is retained in the receptacle connector 100 with the elastic forces Arc4 and Art4, and electrical connection between the conductive terminal 120 and the conductive terminal 220 is stably maintained. In this manner, as illustrated in FIG. 1 to FIG. 3, fitting of the receptacle connector 100 with the plug connector 200 is established. In this manner, the connector device 1 is completed.

Function

There are cases where the sensing switch becomes a closed circuit state, even in the half-fitted state. In this case, although the connector device passes in the conduction test and circulates through the market, the plug connector may be disengaged from the receptacle connector due to vibration or shock from the outside, when the connector device is in the half-fitted state.

However, in some examples, in the state (placed state; first and second pressed states) before the peak P4 of the projecting portion 232*b* of the regulating member 230 moves across the peak P2 of the projecting portion 133*b* of the regulating member 130, the projecting portion 133*b* provides the projecting portion 232*b* with the elastic forces Arc0 to Arc2 (repulsive force) acting in the direction in which the housings 110 and 210 separate from each other, as illustrated in FIG. 11A to FIG. 12B. For this reason, until the peak P4 of the projecting portion 232*b* moves across the peak P2 of the projecting portion 133*b*, the elastic forces Arc0 to Arc2 act between the projecting portions 133*b* and 232*b* to separate the housings 110 and 210 from each other and achieve a non-fitted state in which the conductive terminal 120 of the receptacle connector 100 is not electrically connected with the conductive terminal 220 of the plug connector 200. By contrast, in some examples, in the state (third pressed state) after the peak P4 of the projecting portion 232*b* moves across the peak P2 of the projecting portion 133*b*, the projecting portion 133*b* provides the projecting portion 232*b* with elastic force Arc4 (pull-in force) acting in a direction in which the housings 110 and 210 move toward each other, as illustrated in FIG. 14A and FIG. 14B. For this reason, after the peak P4 of the projecting portion 232*b* moves across the peak P2 of the projecting portion 133*b*, the elastic force Arc4 acts between the projecting portions 133*b* and 232*b*, to bring the housings 110 and 210 close to each other and achieve a fitted state in which electrical connection between the conductive terminals 120 and 220 is established. In this manner, the electrical connection state between the conductive terminals 120 and 220 is stably maintained. As described above, with the elastic forces Arc0 to Arc4 generated between the regulating members 130 and 230, the connectors 100 and 200 are forcibly set to either of the non-fitted state or the fitted state. This structure prevents a half-fitted state between the connectors 100 and 200.

In the state (first pressed state) before the peak P3 of the projecting portion 222*b* of the conductive terminal 220 moves across the peak P1 of the projecting portion 123*a* of the conductive terminal 120, the projecting portion 123*a* provides the projecting portion 222*b* with the elastic force Art1 (repulsive force) acting in the direction in which the housings 110 and 210 separate from each other. For this reason, until the peak P3 of the projecting portion 222*b* moves across the peak P1 of the projecting portion 123*a*, the elastic force Art1 acts between the projecting portions 123*a* and 222*b* to separate the housings 110 and 210 from each other and achieve a non-fitted state in which the receptacle connector 100 is not fitted with the plug connector 200. By contrast, in some examples, in the state after the peak P3 of the projecting portion 222*b* moves across the peak P1 of the projecting portion 123*a*, the projecting portion 123*a* provides the projecting portion 222*b* with elastic forces Art3 and Art4 (pull-in force) acting in a direction in which the housings 110 and 210 move toward each other. For this reason, after the peak P3 of the projecting portion 222*b* moves across the peak P1 of the projecting portion 123*a*, the elastic forces Art3 and Art4 act between the projecting portions 123*a* and 222*b*, to bring the housings 110 and 210 close to each other and achieve a fitted state in which an electrical connection between the conductive terminals 120 and 220 is established. As described above, with the elastic forces generated between the conductive terminals 120 and 220, the connectors 100 and 200 are forcibly set to either of the non-fitted state or the fitted state. This structure further securely prevents a half-fitted state between the connectors 100 and 200.

As illustrated in FIG. 13A and FIG. 13B, the peak P3 of the projecting portion 222*b* of the conductive terminal 220 may move across the peak P1 of the projecting portion 123*a* of the conductive terminal 120 before the peak P4 of the projecting portion 232*b* of the regulating member 230 moves across the peak P2 of the projecting portion 133*b* of the regulating member 130, and the elastic force Art3 is generated between the projecting portions 123*a* and 222*b*. As illustrated in FIG. 12B, the elastic force Art3 is smaller than the elastic force Arc2 generated between the projecting portions 133*b* and 232*b* until the peak P4 of the projecting portion 232*b* moves across the peak P2 of the projecting portion 133*b*. For this reason, until the projecting portion 232*b* of the regulating member 230 moves across the projecting portion 133*b* of the regulating member 130, the housings 110 and 210 are separated from each other with the elastic forces Arc0 to Arc2, to maintain the non-fitted state in which the conductive terminals 120 and 220 are not electrically connected. In other words, the fitted state is created for the first time, not only when the projecting portion 123*a* of the conductive terminal 120 is engaged with the projecting portion 222*b* of the conductive terminal 220 but also when the projecting portion 133*b* of the regulating member 130 is engaged with the projecting portion 232*b* of the regulating member 230. As a result, the half-fitted state between the non-fitted state and the fitted state may be avoided.

Each of the projecting portions 123*a*, 133*b*, 222*b*, and 232*b* has a mountain-like shape that has a decreasing amount of projection on either side of the peak in the vertical direction. This structure enables the elastic force to act on the corresponding projecting portion, with a very simple shape.

In the present embodiment, as illustrated in FIG. 5 and FIG. 6, the height d1 is smaller than the height d2 (d1<d2) in the receptacle connector 100. In addition, as illustrated in FIG. 8 and FIG. 9, the height d3 is larger than the height d4 (d3>d4) in the plug connector 200. This structure enables effective generation of the elastic forces Art1 to Art4 and Arc0 to Arc4.

In the present embodiment, the regulating member 130 includes the proximal end portion 131, and the regulating member 230 includes the proximal end portion 231. For this reason, the regulating members 130 and 230 also have a function similar to the attached portion, namely to attach the respective connectors 100 and 200 to the respective corresponding circuit boards B1 and B2. This structure may use fewer members as compared to other examples, thereby reducing the cost.

As illustrated in FIG. 10A and FIG. 10B, in the placed state, the projecting portion 133*b* of the regulating member 130 abuts against the projecting portion 232*b* of the regulating member 230, but the projecting portion 123*a* of the conductive terminal 120 does not abut against the projecting portion 222*b* of the conductive terminal 220. For this reason, no electricity flows between the conductive terminals 120 and 220. This structure facilitates selection of the connector device 1 in the non-fitted state by execution of a continuity test.

As illustrated in FIG. 4, in the receptacle connector 100, the conductive terminals 120 are attached to the sidewalls 112 and 113, and the regulating members 130 are attached to the sidewall portions 114 and 115. As illustrated in FIG. 7, in the plug connector 200, the conductive terminals 220 are attached to the sidewall portions 212 and 213, and the regulating members 230 are attached to the sidewall portions 214 and 215. For this reason, the conductive terminals 120 and 220 contact each other, and the regulating members 130 and 230 contact each other, in the receiving recessed portion V. This structure reduces the space in which the conductive terminals 120 and 220 contact each other and the regulating members 130 and 230 contact each other, in the fitting direction of the connectors 100 and 200. This structure enables a reduction in size of the connector device 1.

In the receptacle connector 100, a pair of regulating members 130 are positioned to interpose the conductive terminals 120 therebetween. In the plug connector 200, a pair of regulating members 230 are positioned to interpose the conductive terminals 220 therebetween. For this reason, engaging the regulating members 130 and 230 to each other retains the fitted state of the connectors 100 and 200 on both ends of the connector device 1. Accordingly, when the connectors 100 and 200 are fitted with each other, the connectors 100 and 200 remain securely engaged.

Other Embodiments

Example embodiments have been explained above in detail, but various modifications may be made to the embodiment described above.

Figure 15:
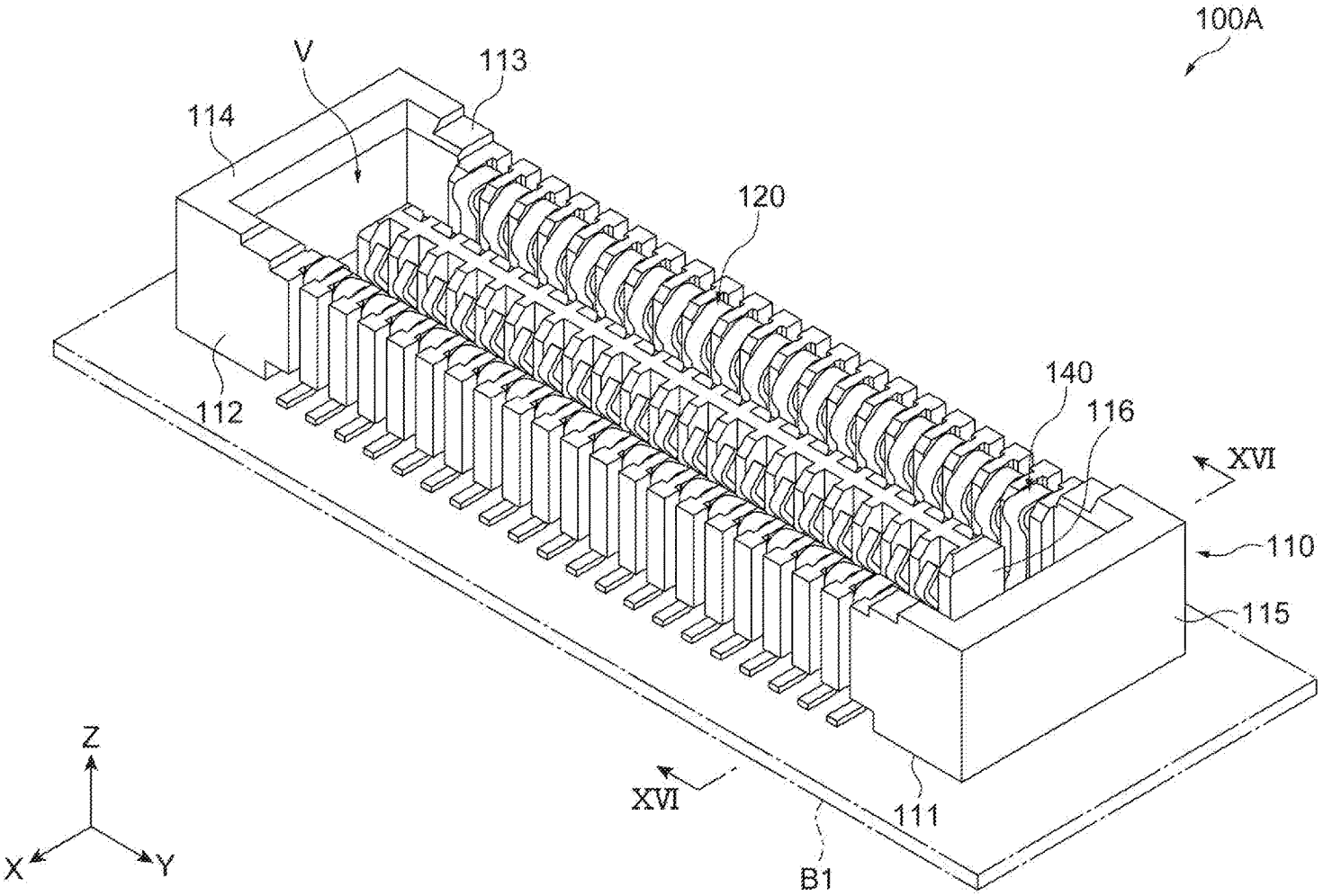
FIG. 15 is a perspective view illustrating another example (second example) of the receptacle connector.
Figure 16:
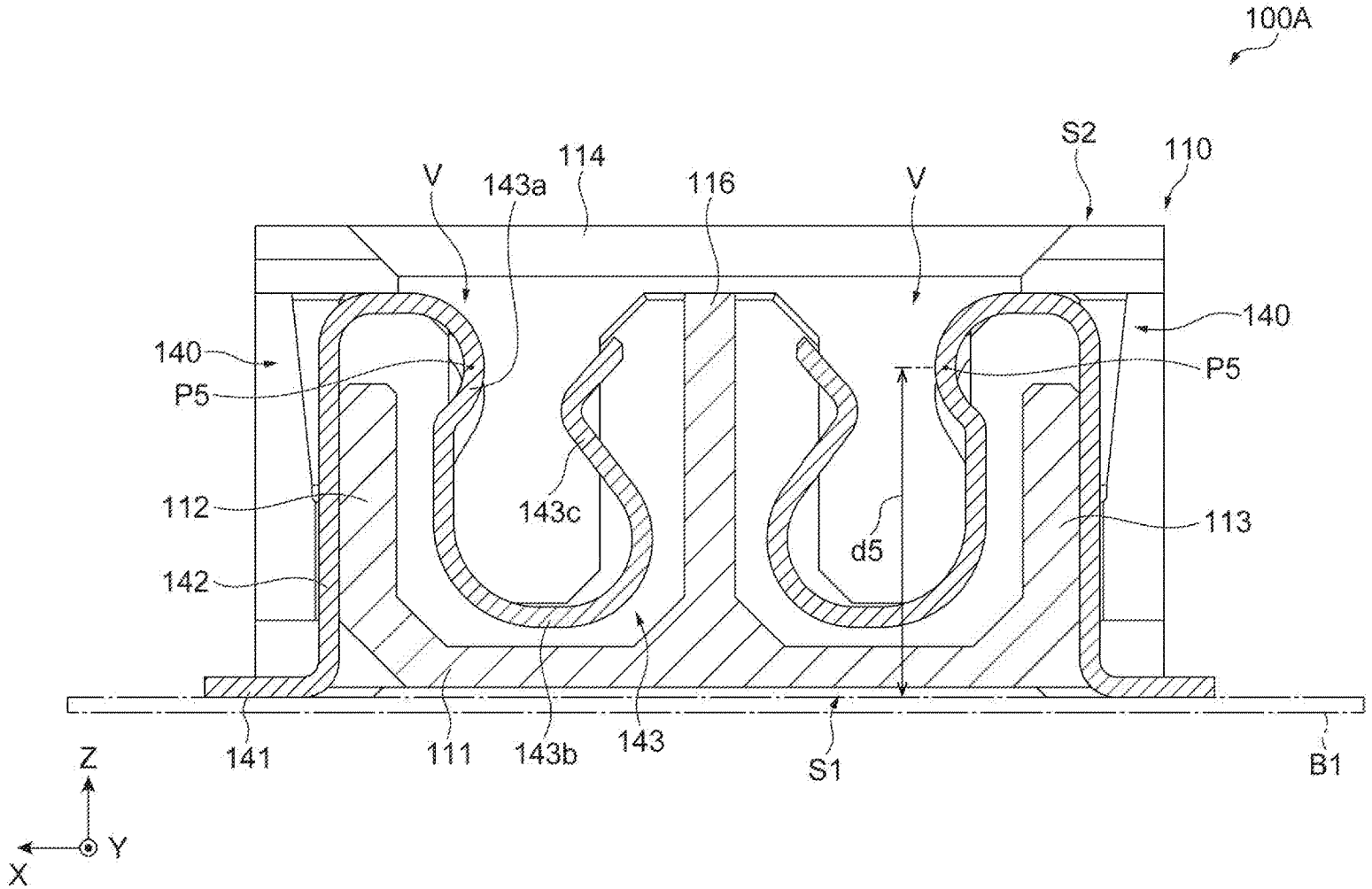
FIG. 16 is a cross-sectional view taken along line XVI-XVI of FIG. 15.

(1) For example, a receptacle connector 100A illustrated in FIG. 15 and FIG. 16 may be used, instead of the receptacle connector 100. The receptacle connector 100A is different from the receptacle connector 100, in the shape of the sidewall portions 114 and 115, the number of the conductive terminals 120, and in that a plurality of regulating members 140 are provided instead of the regulating members 130. The following explanation mainly illustrates these differences.

The sidewall portions 114 and 115 are provided with no slits, and provided with no regulating members 130. Although not illustrated, no regulating members 230 are attached to the sidewall portions 214 or 215 of the plug connector 200 corresponding to the receptacle connector 100A. In the receptacle connector 100A, 18 conductive terminals 120 are attached to each of the sidewall portions 112 and 113.

A pair of regulating members 140 are positioned to interpose the conductive terminals 120 therebetween in the sidewall portion 112. Each of the regulating members 140 is formed of a plate-like conductive material (such as a metal member). In the same manner as the conductive terminals 120, each of the regulating members 140 includes a proximal end portion 141 (attached portion), a middle portion 142, and a contact portion 143, as illustrated in FIG. 16. The contact portion 143 includes a projecting portion 143*a*, a curved portion 143*b*, and a projecting portion 143*c*. In comparison with the conductive terminal 120, the position of a peak P5 of the projecting portion 143*a* is different from the peak P1 (see FIG. 6) of the projecting portion 123*a*. Specifically, a height d5 in the Z direction from the surface of the circuit board B1 to the peak P5 of the projecting portion 143*a* is set higher than the height d1. Specifically, the peak P5 is positioned higher (opposed surface S2 side) than the peak P1. In the form of FIG. 15 and FIG. 16, the regulating members 140 may function as the conductive terminals.

Figure 17A:
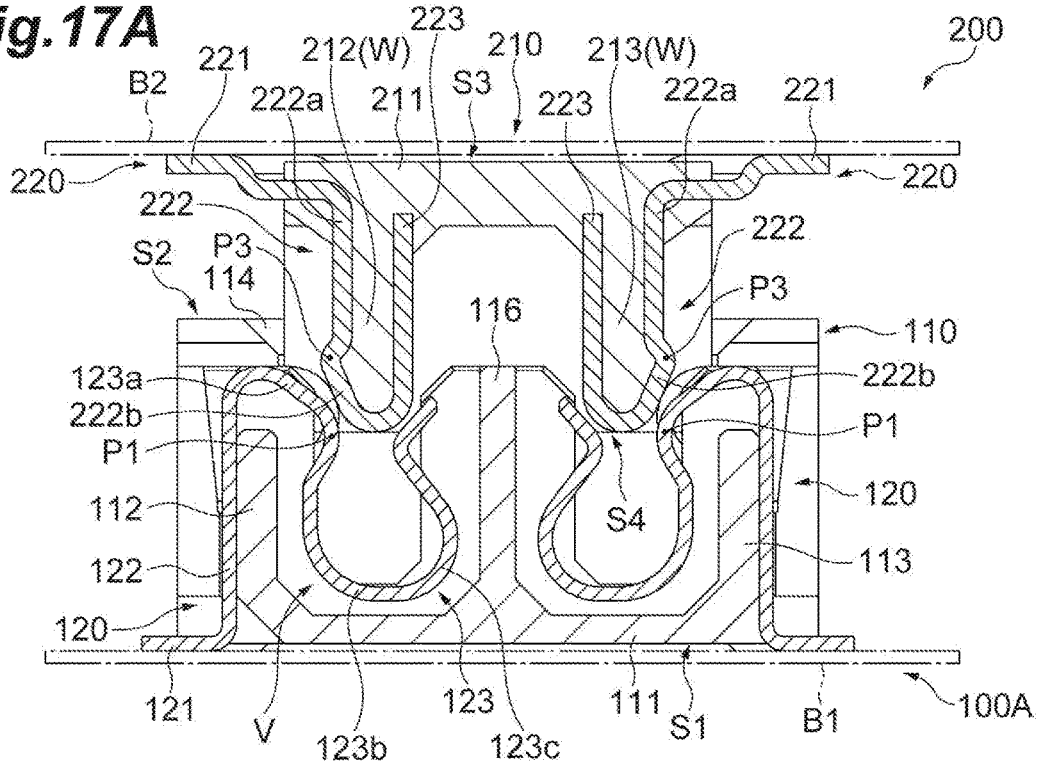
FIG. 17A is a cross-sectional view for explaining a placed state in a process in which terminals in the vicinity of the center of connectors according to the second example are fitted.

The following is an explanation of a process of fitting the receptacle connector 100A with the plug connector 200, with reference to FIG. 17A to FIG. 21B. First, as illustrated in FIG. 17A and FIG. 17B, the plug connector 200 is placed on the receptacle connector 100A. In this state, the conductive terminals 120 and the regulating members 140 are opposed to the respective corresponding conductive terminals 220. The conductive terminals 220 corresponding to the regulating members 140 may function as regulating members.

Figure 17B:
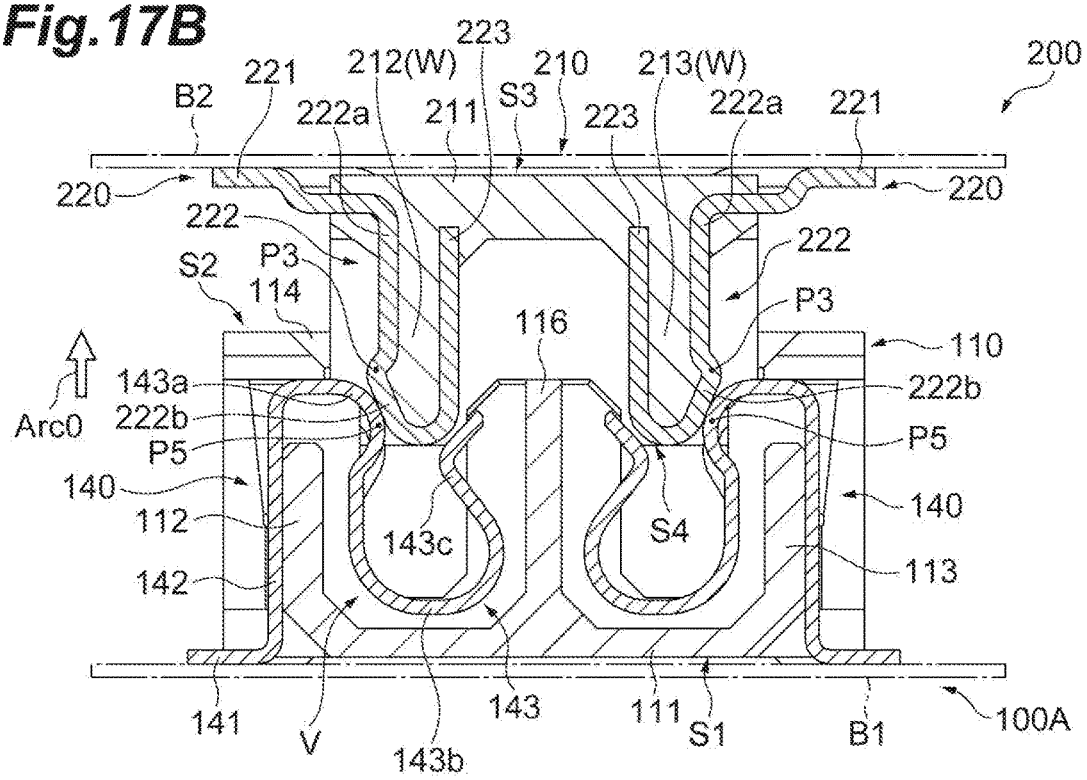
FIG. 17B is a cross-sectional view for explaining a placed state in a process in which terminals in the vicinity of end portions of the connectors according to the second example are fitted.

In the placed state, as illustrated in FIG. 17B, the upper inclined surface of the projecting portion 143*a* (opposed surface S2 side) located above the peak P5 of the projecting portion 143*a* abuts against the lower inclined surface of the projecting portion 222*b* (opposed surface S4 side) located below the peak P3. For this reason, the projecting portion 143*a* provides the projecting portion 222*b* with its reaction force, while receiving the weight of the plug connector 200. Accordingly, the regulating member 140 provides the projecting portion 222*b* with elastic force Arc0 acting in a direction in which the plug connector 200 separates from the receptacle connector 100A. By contrast, in the placed state, as illustrated in FIG. 17A, the projecting portion 123*a* of the conductive terminal 120 does not abut against the projecting portion 222*b* of the conductive terminal 220 corresponding to the conductive terminal 120. For this reason, the conductive terminal 120 is not electrically connected with the conductive terminal 220.

Figure 18A:
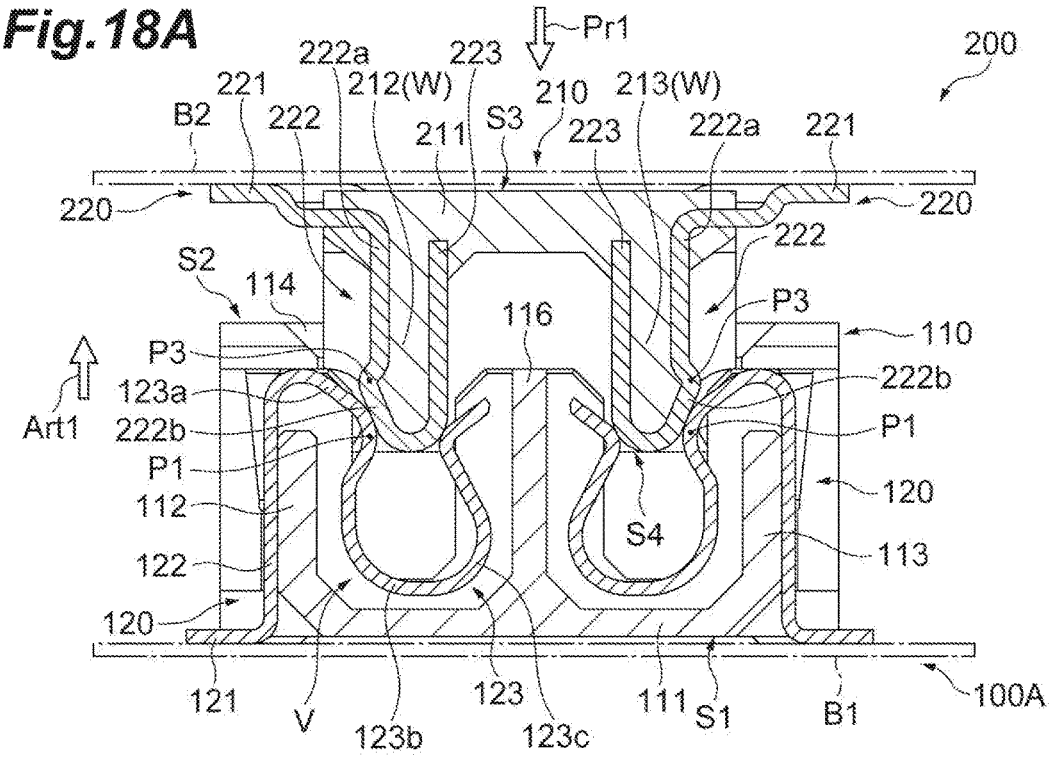
FIG. 18A is a cross-sectional view for explaining a first pressed state in the process in which the terminals in the vicinity of the center of the connectors according to the second example are fitted.
Figure 18B:
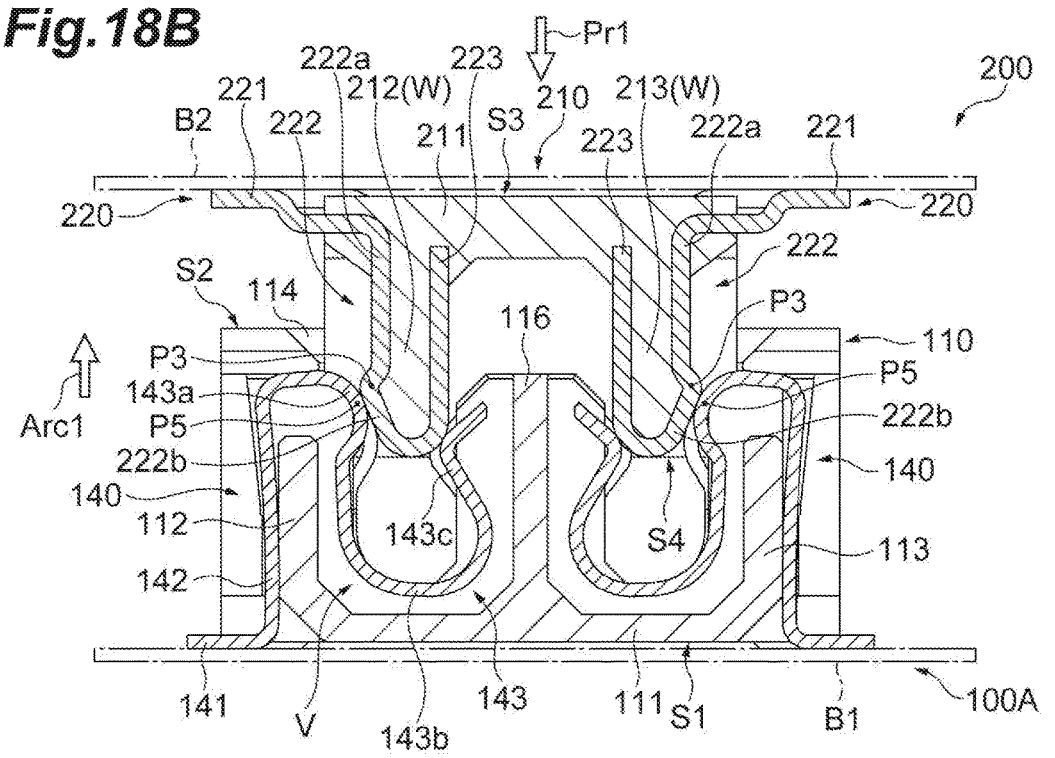
FIG. 18B is a cross-sectional view for explaining a first pressed state in the process in which the terminals in the vicinity of the end portions of the connectors according to the second example are fitted.

Thereafter, as illustrated in FIG. 18A and FIG. 18B, pressure Pr1 is applied to the plug connector 200 in the placed state, to push the plug connector 200 into the receptacle connector 100A. In the first pressed state, as illustrated in FIG. 18B, the projecting portion 222*b* is provided with the elastic force Arc1 acting in the separating direction, from the regulating member 140. By contrast, in the first pressed state, as illustrated in FIG. 18A, the projecting portion 222*b* is provided with the elastic force Art1 acting in the separating direction, from the corresponding conductive terminal 120. Accordingly, when the pressure Pr1 is removed at this point in time, the plug connector 200 is returned to the placed state, in response to the elastic forces Arc1 and Art1. Specifically, the conductive terminal 120 and the conductive terminal 220 are returned to the electrically non-connected state from the electrically connected state.

Figure 19A:
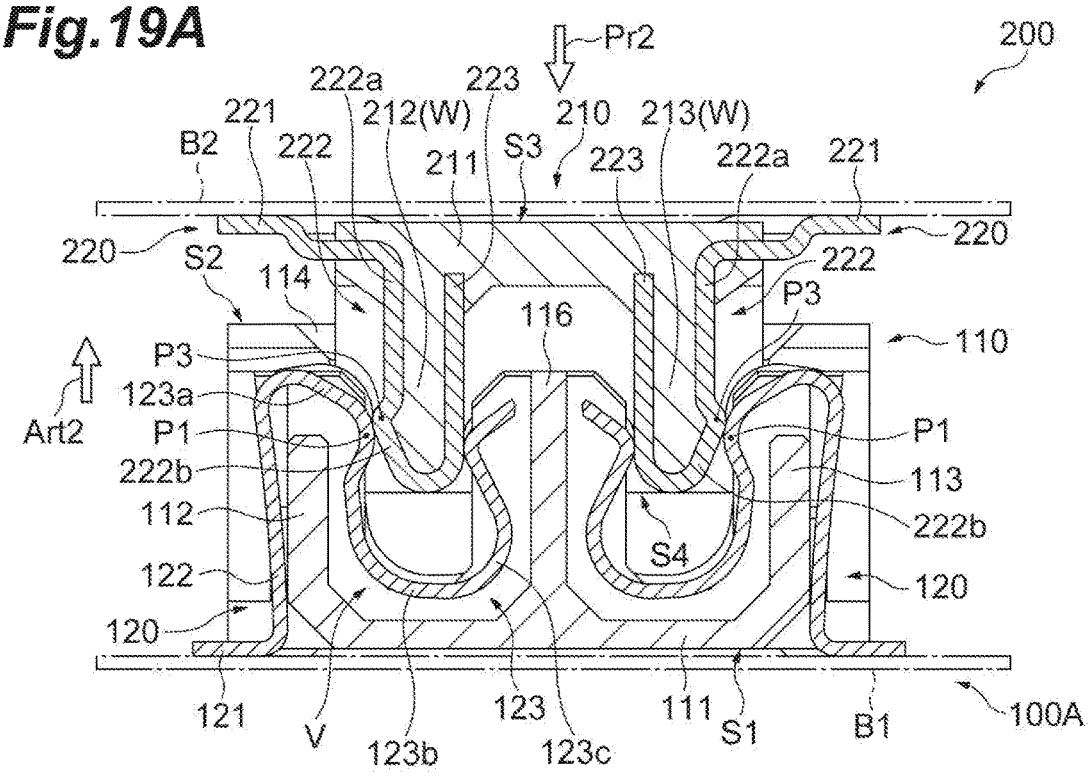
FIG. 19A is a cross-sectional view for explaining a second pressed state in the process in which the terminals in the vicinity of the center of the connectors according to the second example are fitted.
Figure 19B:
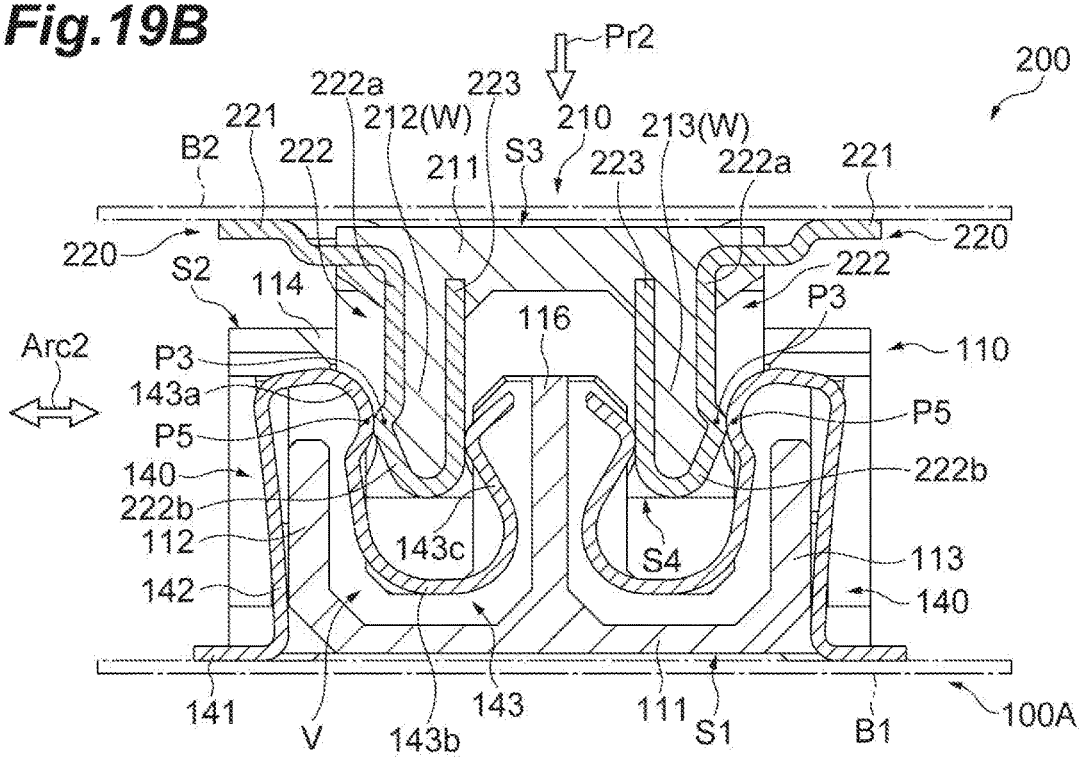
FIG. 19B is a cross-sectional view for explaining a second pressed state in the process in which the terminals in the vicinity of the end portions of the connectors according to the second example are fitted.

Thereafter, as illustrated in FIG. 19A and FIG. 19B, pressure Pr2 is applied to the plug connector 200 in the first pressed state, to further push the plug connector 200 into the receptacle connector 100A. In the second pressed state, as illustrated in FIG. 19B, the peak P3 of the projecting portion 222*b* is located in a position substantially as high as the peak P5 of the projecting portion 143*a*. For this reason, a force in the horizontal direction acts on the peak P5 of the projecting portion 143*a* and the peak P3 of the projecting portion 222*b*, in response to the elastic force Arc2 of the contact portion 143 of the regulating member 140. For this reason, the regulating member 140 applies no elastic force in a direction in which the connectors 100A and 200 separate from each other or move toward each other, to the projecting portion 222*b*. By contrast, in the second pressed state, as illustrated in FIG. 19A, the projecting portion 222*b* is provided with the elastic force Art2 acting in the separating direction, from the corresponding conductive terminal 120. Accordingly, when the pressure Pr2 is removed at this point in time, the plug connector 200 is returned to the placed state, in response to the elastic forces Art2. Specifically, the conductive terminal 120 and the conductive terminal 220 are returned to the electrically non-connected state from the electrically connected state.

Figure 20A:
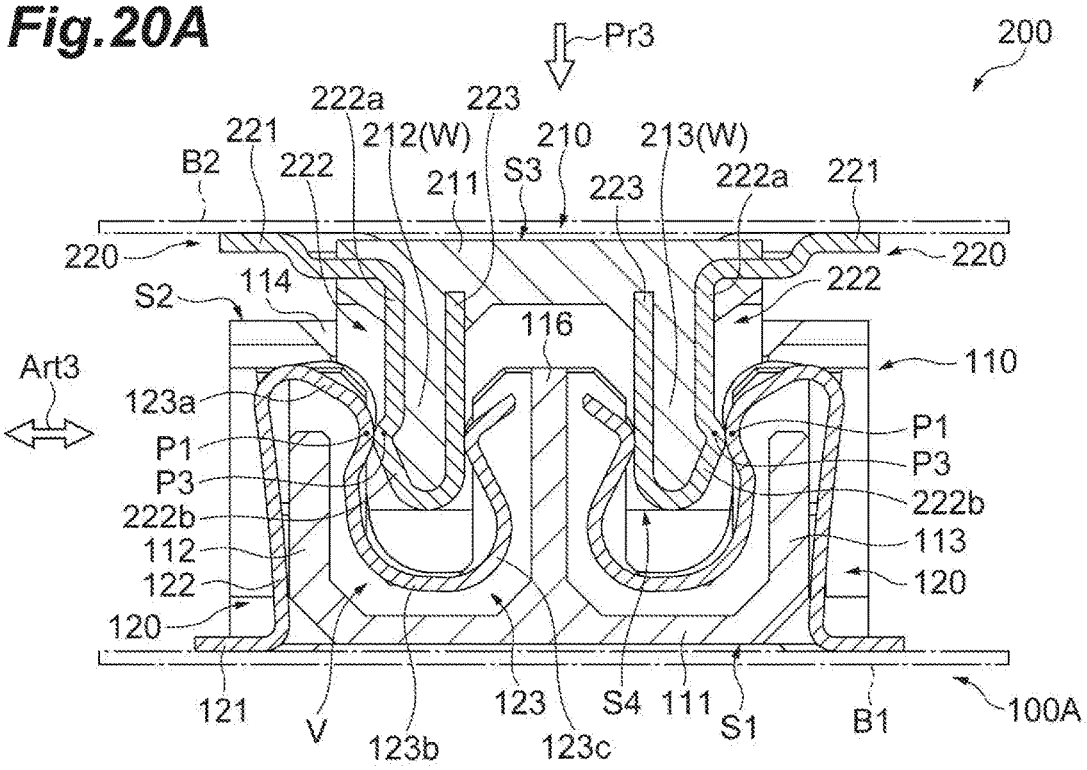
FIG. 20A is a cross-sectional view for explaining a third pressed state in the process in which the terminals in the vicinity of the center of the connectors according to the second example are fitted.
Figure 20B:
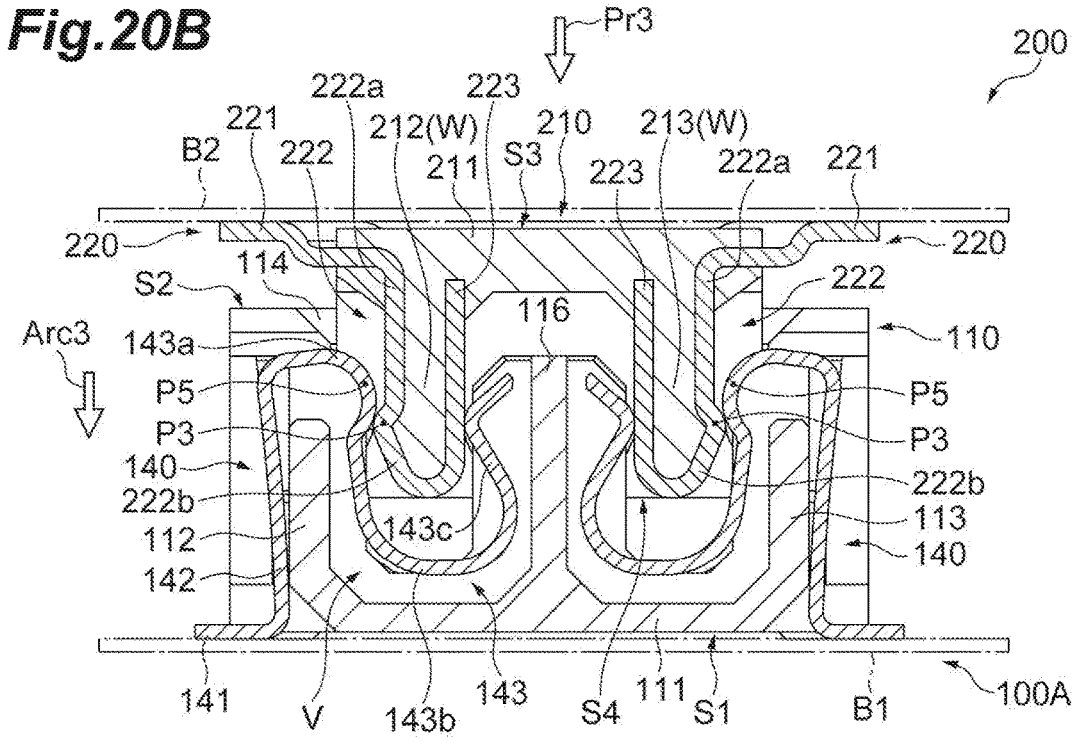
FIG. 20B is a cross-sectional view for explaining a third pressed state in the process in which the terminals in the vicinity of the end portions of the connectors according to the second example are fitted.

Thereafter, as illustrated in FIG. 20A and FIG. 20B, pressure Pr3 is applied to the plug connector 200 in the second pressed state, to further push the plug connector 200 into the receptacle connector 100A. In the third pressed state, as illustrated in FIG. 20B, the lower inclined surface of the projecting portion 143*a* (mounting surface S1 side) located below the peak P5 abuts against the upper inclined surface of the projecting portion 222*b* (mounting surface S3 side) located above the peak P3. The projecting portion 222*b* moves downward while pushing the projecting portion 143*a* outward, in response to the elastic force of the contact portion 143 of the regulating member 140. For this reason, the projecting portion 143*a* reduces the horizontal displacement amount caused by the projecting portion 222*b* and provides the projecting portion 222*b* with a reaction force that operates to return the regulating member 140 to its original shape. Accordingly, the regulating terminal 140 provides the projecting portion 222*b* with elastic force Arc3 acting in a direction in which the plug connector 200 comes close to the receptacle connector 100A. By contrast, in the third pressed state, as illustrated in FIG. 20A, a force in the horizontal direction acts on the peak P1 of the projecting portion 123*a* and the peak P3 of the corresponding projecting portion 222*b*, in response to the elastic force Art3 of the contact portion 123 of the conductive terminal 120. For this reason, the conductive terminal 120 applies no elastic force in a direction in which the connectors 100A and 200 separate from each other or move toward each other, to the projecting portion 222*b*. Accordingly, the plug connector 200 is pulled into the receptacle connector 100A in response to the elastic force Arc3.

Figure 21A:
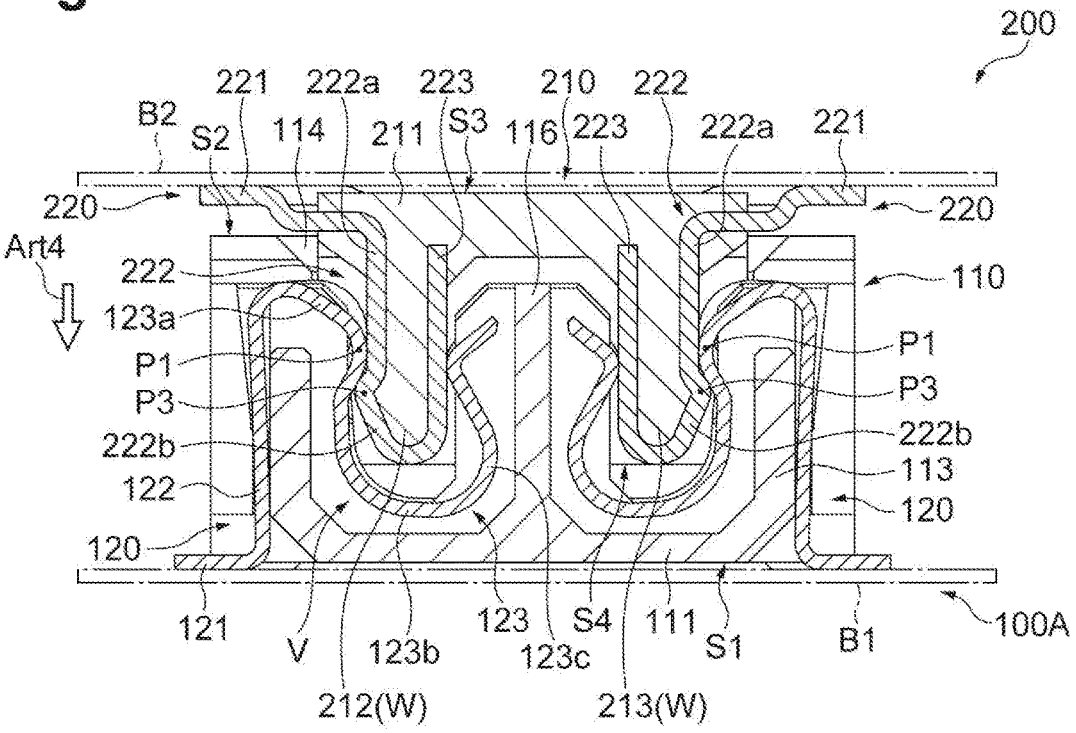
FIG. 21A is a cross-sectional view for explaining a fitted state in the process in which the terminals in the vicinity of the center of the connectors according to the second example are fitted.
Figure 21B:
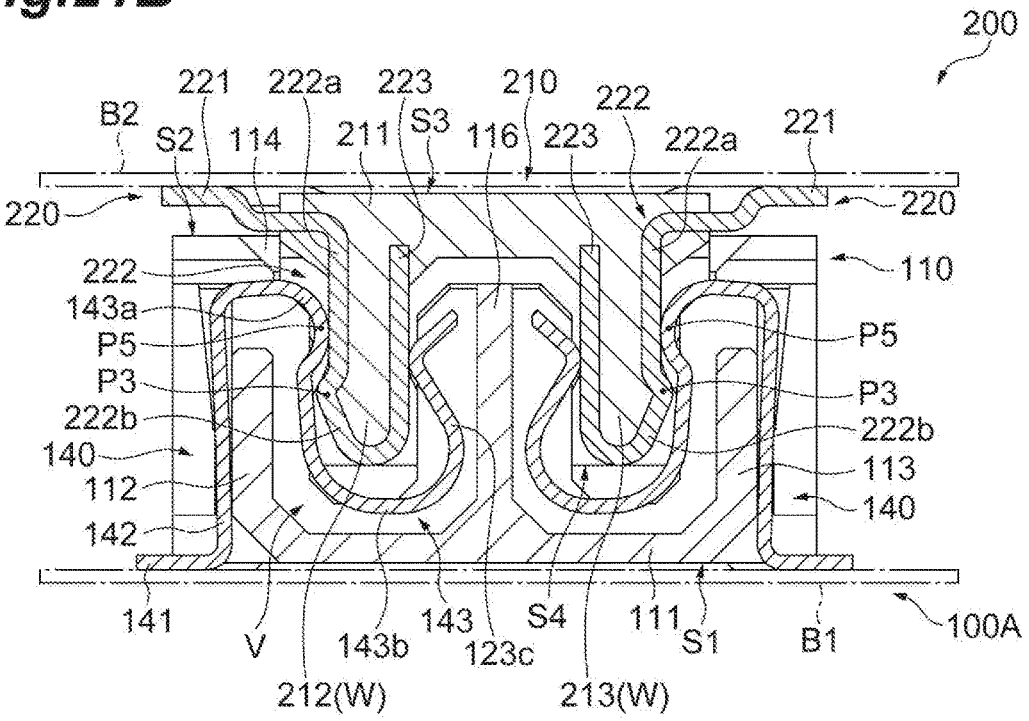
FIG. 21B is a cross-sectional view for explaining a fitted state in the process in which the terminals in the vicinity of the end portions of the connectors according to the second example are fitted.
Figure 22:
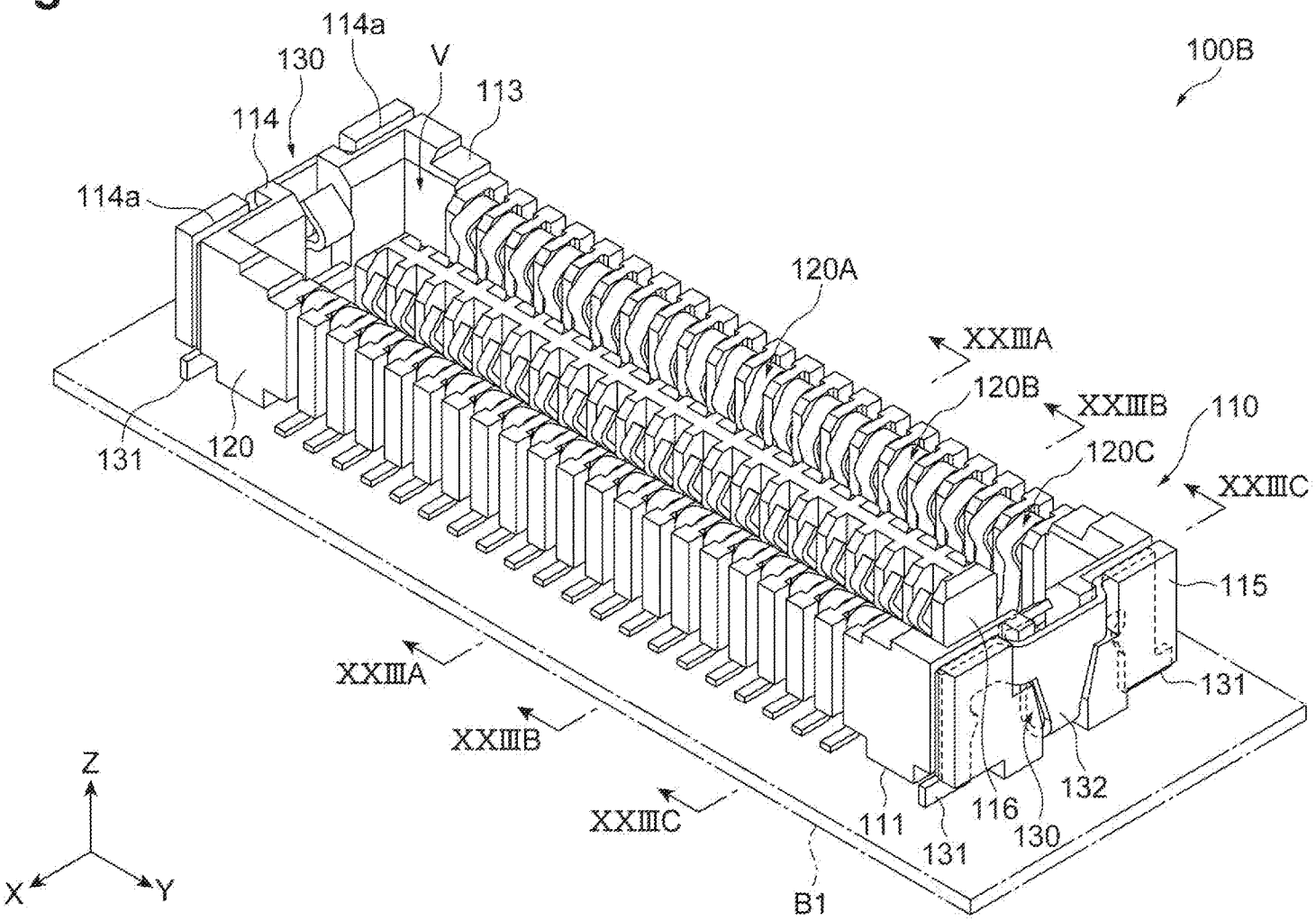
FIG. 22 is a perspective view illustrating another example (third example) of the receptacle connector.

When the plug connector 200 is pulled into the receptacle connector 100A, as illustrated in FIG. 21B, the corresponding conductive terminal 120 is inserted into the contact portion 143. By contrast, as illustrated in FIG. 21A, the lower inclined surface of the projecting portion 123*a* (mounting surface S1 side) located below the peak P1 abuts against the upper inclined surface of the projecting portion 222*b* (mounting surface S3 side) located above the peak P3. The projecting portion 222*b* moves downward while pushing the projecting portion 123*a* outward. For this reason, the projecting portion 123*a* provides the projecting portion 222*b* with a reaction force that operates to return the conductive terminal 120 to its original shape. Accordingly, the conductive terminal 120 provides the projecting portion 222*b* with elastic force Art4 acting in a direction in which the plug connector 200 comes close to the receptacle connector 100A. For this reason, the plug connector 200 is further pulled into the receptacle connector 100A, in response to the elastic force Art4. In this manner, fitting of the receptacle connector 100A with the plug connector 200 is established. The connector device 1 is completed in this manner.

Figure 23A:
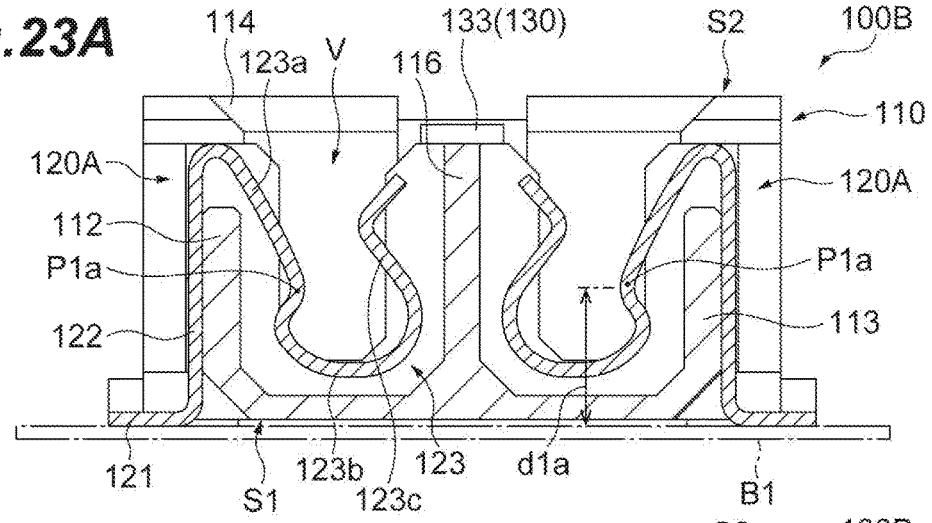
FIG. 23A is a cross-sectional view taken along line XXIIIA-XXIIIA of FIG. 22.
Figure 23B:
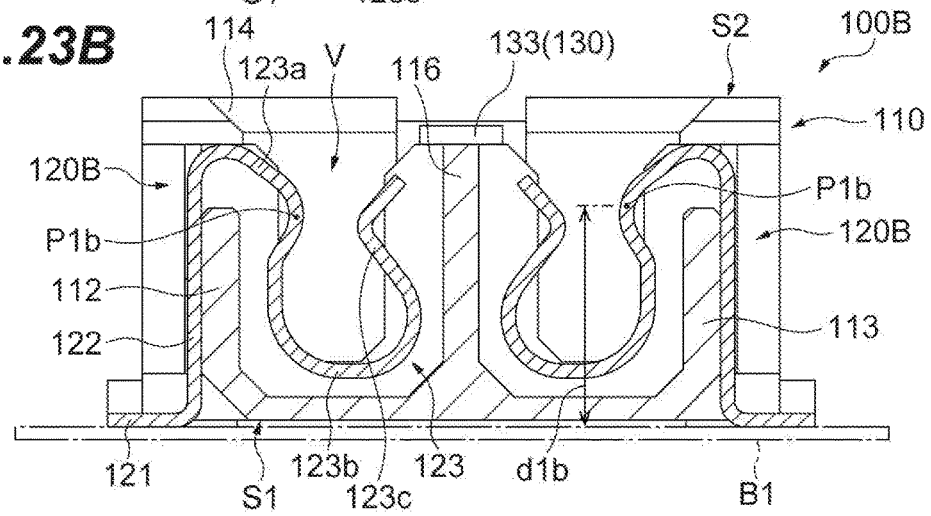
FIG. 23B is a cross-sectional view taken along line XXIIIB-XXIIIB of FIG. 22.
Figure 23C:
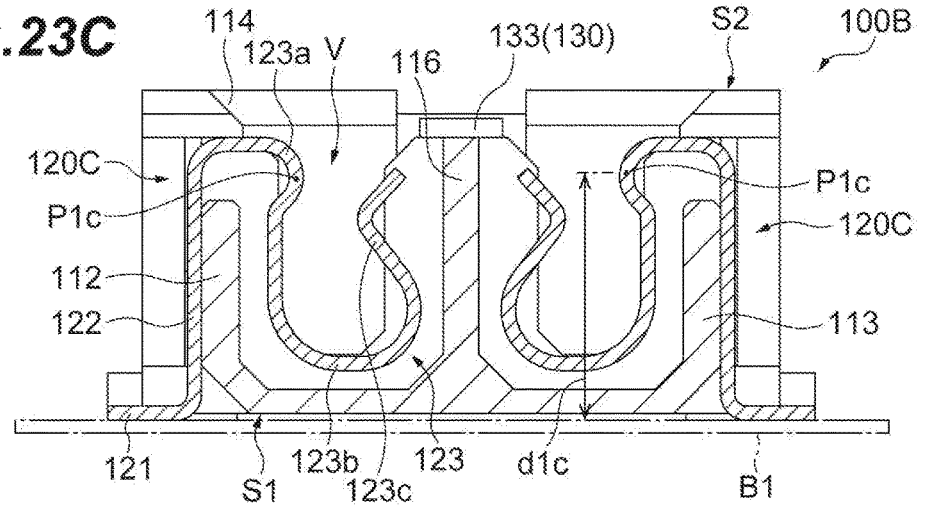
FIG. 23C is a cross-sectional view taken along line XXIIIC-XXIIIC of FIG. 22.

(2) As illustrated in FIG. 22 and FIG. 23A to FIG. 23C, in the receptacle connector 100B, the peaks P1 of the respective conductive terminals 120 may successively be located closer to the upper side (opposed surface S2 side) from the vicinity center of the line of the connector 100B toward the end portions in an arrangement direction (Y direction) in which the conductive terminals 120 are arranged. The conductive terminals 120 positioned in the vicinity of the center line of the connector 100B in the arrangement direction are referred to as "conductive terminals 120A", the conductive terminals 120 positioned between the vicinity of the center line of the connector 100B and the end portions are referred to as "conductive terminals 120B", and the conductive terminals 120 positioned in the end portions of the connector 100B in the arrangement direction are referred to as "conductive terminals 120C". As illustrated in FIG. 23A to FIG. 23C, d1*a*<d1*b*<d1*c* is satisfied, when parameters d1*a*, d1*b*, and d1*c* are defined as follows:

d1*a*: the height in the Z direction from the surface of the circuit board B1 to the peak P1*a* of the projecting portion 123*a* of the conductive terminal 120A;

d1*b*: the height in the Z direction from the surface of the circuit board B1 to the peak P1*b* of the projecting portion 123*a* of the conductive terminal 120B; and d1*c*: the height in the Z direction from the surface of the circuit board B1 to the peak P1*c* of the projecting portion 123*a* of the conductive terminal 120C.

Specifically, the peak P1*a* is positioned lower (mounting surface S1 side) than the peak P1*b*. The peak P1*b* is positioned lower (mounting surface S1 side) than the peak P1*c*.

In this case, in the process of fitting the connectors 100B and 200, first, the projecting portions 123*a* of the conductive terminals 120C are engaged with the projecting portions 222*b* of the conductive terminals 220, thereafter the projecting portions 123*a* of the conductive terminals 120B are engaged with the projecting portions 222*b* of the conductive terminals 220, and lastly the projecting portions 123*a* of the conductive terminals 120A are engaged with the projecting portions 222*b* of the conductive terminals 220. For this reason, in the process of fitting the connectors 100B and 200, elastic force Ar3 (pull-in force) acts in a phased manner between the projecting portions 123*a* and 222*b*. This structure facilitates fitting of the connectors 100B and 200, without application of large external force.

The peaks P1 of part of the conductive terminals 120 may successively be located closer to the upper side (opposed surface S2 side) in the arrangement direction. The same is applicable to the conductive terminals 220 included in the plug connector 200.

Figure 24:
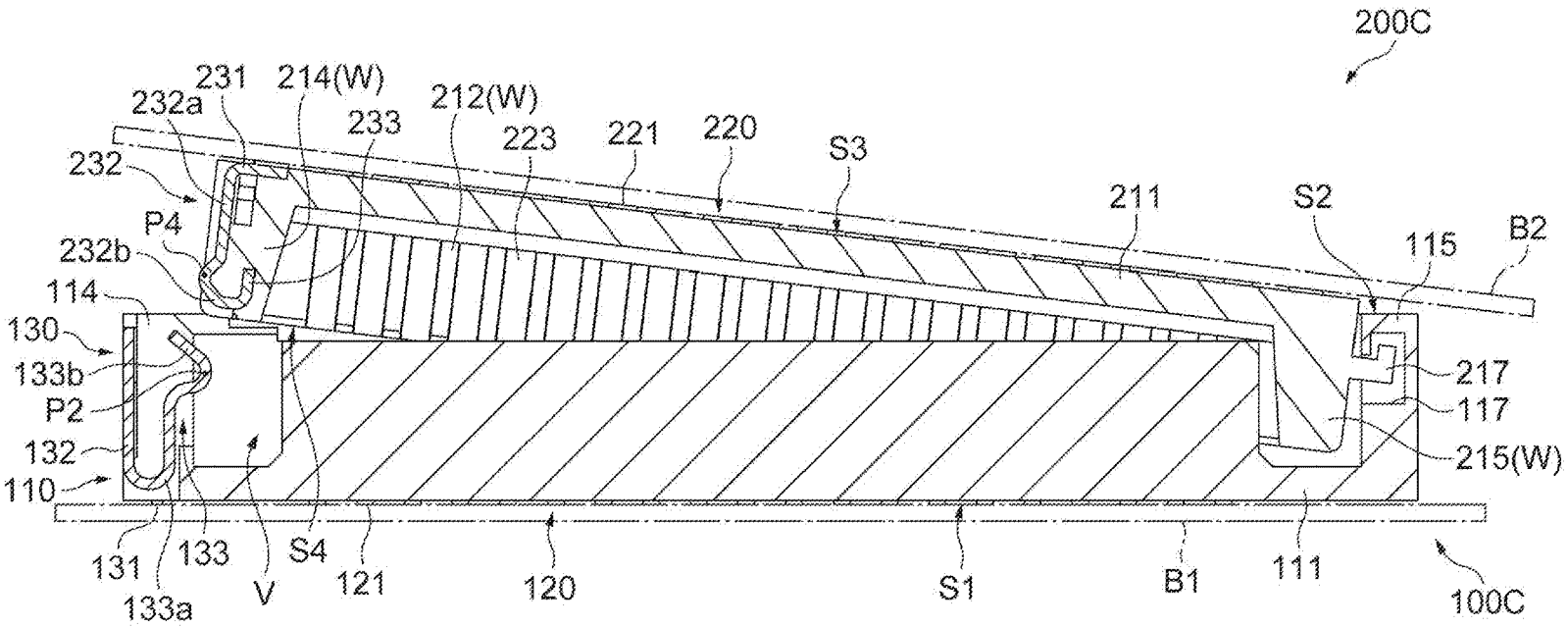
FIG. 24 is a diagram for explaining a state in which the receptacle connector and the plug connector are fitted, in another example (fourth example) of the connector device.

(3) As illustrated in FIG. 24, one of the connectors may include a locking hole, and another connector may include a locking piece. Specifically, in FIG. 24, the sidewall portion 115 of a receptacle connector 100C is provided with a locking hole 117 opened to the inside, instead of the regulating member 130. The sidewall portion 215 of a plug connector 200C is provided with a locking piece 217 projecting outward, instead of the regulating member 230. When the connectors 100C and 200C are fitted with each other, first, the locking piece 217 may be locked in the locking hole 117, and the plug connector 200C may be turned with respect to the receptacle connector 100C, with the locking piece 217 locked in the locking hole 117 as the fulcrum, to engage the projecting portion 232*b* of the regulating member 230 in the sidewall portion 214 with the projecting portion 133*b* of the regulating member 130 in the sidewall portion 114.

(4) The shapes of the housings 110 and 210 are not always limited to the rectangular-parallelepiped shapes, but may be other shapes (such as a cube shape, a prism shape, and a cylinder shape).

(5) At least one of the projecting portions 123*a* and 222*b* may be elastically deformed. In the same manner, at least one of the projecting portions 133*b* and 232*b* may be elastically deformed.

(6) The projecting portions 123*a*, 133*b*, 222*b*, and 232*b* may not have a mountain-like shape. For example, it suffices that the projecting portion 123*a* provided in the sidewall portion 112 projects from the sidewall portion 112 toward the sidewall portion 113 or the center wall portion 116 (corresponding conductive terminal 220). Specifically, it suffices that the upper portion (portion between the peak P1 and the middle portion 122) of the projecting portion 123*a* located above the peak P1 is inclined to approach the sidewall portion 112 as it extends upward (toward the opposed surface S2), as viewed from the peak P1. By contrast, the lower portion (portion between the peak P1 and the curved portion 123*b*) of the projecting portion 123*a* located below the peak P1 is not always inclined to approach the sidewall portion 112 as it extends downward (toward the mounted surface S1), as viewed from the peak P1. The same is applicable to the other projecting portions 133*b*, 222*b*, and 232*b*.

(7) In the placed state, the conductive terminals 120 and 220 may contact each other.

(8) The regulating members 130 are not always positioned to interpose the conductive terminals 120 therebetween. Specifically, the regulating members 130 may be located in predetermined positions with respect to the conductive terminals 120. The same is applicable to the regulating members 230.

(9) The receptacle connector 100 may include at least one regulating member 130, and the plug connector 200 may include at least one regulating member 230.

(10) The conductive terminals 120 and 220 may not include projecting portions 123*a* and 222*b*, respectively, and the connectors 100 and 200 may be fitted with each other by the projecting portions 133*b* and 232*b* of the regulating members 130 and 230.

(11) The regulating members 130 may not function as attached portions, and the receptacle connector 100 may be attached to the circuit board B1 with another member. The same is also applicable to the regulating members 230.

(12) Because it suffices that an elastic force acts between the regulating members 130 and 230, the regulating members 130 and 230 may be formed of a material other than metal. Specifically, the regulating members 130 and 230 may be resin members or the like. The regulating members 130 and 230 may be formed of the same material as that of the housings 110 and 210, and may be integrated with the housings 110 and 210, respectively.

The devices and methods described herein may be embodied in a variety of other forms; furthermore, various omissions, substitutions and changes in the form of the devices and methods described herein may be made in arrangement and detail. The accompanying claims and their equivalents are intended to cover such forms or modification as would fall within the scope and spirit of the subject matter claimed herein.

What is claimed is:

1. A connector device comprising:

a first connector including a first insulating housing, a plurality of first conductive terminals attached to the first insulating housing, and at least one first regulating member attached to the first insulating housing; and a second connector including a second insulating housing, a plurality of second conductive terminals attached to the second insulating housing, and at least one second regulating member attached to the second insulating housing, wherein the first insulating housing is provided with a fitting projecting portion extending vertically from a bottom surface of the first insulating housing, and the second insulating housing is provided with a recessed portion configured to receive the fitting projecting portion, wherein each of the first and the second regulating members includes a projecting portion that is configured to move across each other in order to place the connector device in a fitted state in which the fitting projecting portion is received in the recessed portion, wherein a first projecting portion of either one of the first and the second regulating members is configured to provide a second projecting portion of the other regulating member with a first elastic force acting in a first direction in which the first and the second insulating housings separate from each other, before the first projecting portion moves across the second projecting portion, wherein the first projecting portion is configured to provide the second projecting portion with a second elastic force acting in a second direction in which the first and the second insulating housings move toward each other, after the first projecting portion moves across the second projecting portion, to electrically connect the first conductive terminals with the second conductive terminals, wherein at least one of the first conductive terminals includes a projecting portion that projects toward the corresponding second conductive terminal in the fitted state, wherein at least one of the second conductive terminals includes a projecting portion that projects toward the corresponding first conductive terminal in the fitted state, wherein a third projecting portion of either one of the first and the second conductive terminals is configured to provide a fourth projecting portion of the other conductive terminal with a third elastic force acting in the first direction in which the first and the second insulating housings separate from each other, before the third projecting portion moves across the fourth projecting portion, and wherein the third projecting portion is configured to provide the fourth projecting portion with a fourth elastic force acting in the second direction in which the first and the second insulating housings move toward each other, after the third projecting portion moves across the fourth projecting portion of the other.

2. The connector device according to claim 1, wherein the first projecting portion comprises a mountain-like shape that is configured to provide a decreasing amount of elastic force on either side of a peak of the first projecting portion in the first and second directions.

3. The connector device according to claim 1, wherein the fourth elastic force is smaller than the first elastic force, after the third projecting portion moves across the fourth projecting portion and before the first projecting portion moves across the second projecting portion.

4. The connector device according to claim 1, wherein the third projecting portion has a mountain-like shape that is configured to provide a decreasing amount of elastic force on either side of a peak of the third projecting portion in the first direction and the second direction.

5. The connector device according to claim 1, wherein the first insulating housing includes a first mounting surface facing a first circuit board in the fitted state, and a first opposed surface located on an opposite side of the first insulating housing as the first mounting surface, the first opposed surface positioned on a distal end of the fitting projecting portion extending vertically from the bottom surface of the first insulating housing, wherein the second insulating housing includes a second mounting surface facing a second circuit board in the fitted state, and a second opposed surface located on an opposite side of the second insulating housing as the second mounting surface, the second opposed surface positioned on an open side of the recessed portion, wherein each of the projecting portions of the first and the second regulating members has a mountain-like shape that is configured to provide a decreasing amount of elastic force on either side of a peak thereof in the first and second directions, wherein each of the projecting portions of the first and the second conductive terminals has a mountain-like shape that is configured to provide a decreasing amount of elastic force on either side of a peak thereof in the first and second directions, wherein in a first positional relation (A), the peak of the projecting portion of the first conductive terminals is positioned in the first opposed surface side beyond the peak of the projecting portion of the first regulating member in the first and second directions, and the peak of the projecting portion of the second regulating member is positioned in the second opposed surface side beyond the peak of the projecting portion of the second conductive terminals in the first and second directions, and wherein in a second positional relation (B), the peak of the projecting portion of the first regulating member is positioned in the first opposed surface side beyond the peak of the projecting portion of the first conductive terminals in the first and second directions, and the peak of the projecting portion of the second conductive terminals is positioned in the second opposed surface side beyond the peak of the projecting portion of the second regulating member in the first and second directions.

6. The connector device according to claim 5, wherein the first regulating member includes a first attachment attached portion configured to attach the first connector to the first circuit board, and wherein the second regulating member includes a second attachment portion configured to attach the second connector to the second circuit board.

7. The connector device according to claim 1, wherein the first and the second regulating members are configured to abut against each other, without the first and the second conductive terminals contacting each other, prior to the fitting projecting portion being received in the recessed portion in the fitted state.

8. The connector device according to claim 1, wherein in the fitted state:

the first regulating member and the first conductive terminals are arranged in a wall portion of the recessed portion, the second regulating member and the second conductive terminals are arranged in a wall portion of the fitting projecting portion, the projecting portions of the first regulating member and the first conductive terminals project outward from the wall portion of the fitting projecting portion, and the projecting portions of the second regulating member and the second conductive terminals project inward from the wall portion of the recessed portion.

9. The connector device according to claim 1, wherein the first connector includes a first pair of regulating members, wherein the second connector includes a second pair of regulating members, wherein the first pair of regulating members are positioned to interpose the first conductive terminals therebetween in a direction in which the first conductive terminals are arranged, and wherein the second pair of regulating members are positioned to interpose the second conductive terminals therebetween in a direction in which the second conductive terminals are arranged.

10. A connector device comprising:

a first connector including a first insulating housing, a plurality of first conductive terminals attached to the first insulating housing, and a first regulating member attached to the first insulating housing; and a second connector including a second insulating housing, a plurality of second conductive terminals attached to the second insulating housing, and a second regulating member attached to the second insulating housing, wherein, during an initial range of contact when fitting the first connector to the second connector, a first projecting portion associated with the first regulating member is configured to provide a second projecting portion associated with the second regulating member with a first elastic force acting in a first direction associated with disengaging the first and second insulating housings from each other, and a third projecting portion associated with at least one of the first conductive terminals is configured to provide a fourth projecting portion associated with at least one of the second conductive terminals with a third elastic force acting in the first direction, and wherein, during a subsequent range of contact when fitting the first connector to the second connector, the first projecting portion is configured to provide the second projecting portion with a second elastic force acting in a second direction associated with engaging the first and second insulating housings to each other, and the third projecting portion is configured to provide the fourth projecting portion with a fourth elastic force acting in the second direction.

11. The connector device according to claim 10, wherein the first insulating housing is provided with a fitting projecting portion extending vertically from a bottom surface of the first insulating housing, and wherein the second insulating housing is provided with a recessed portion configured to receive the fitting projecting portion when the first and second insulating housings are engaged to each other.

12. The connector device according to claim 10, wherein the second insulating housing is provided with a fitting projecting portion extending vertically from a bottom surface of the second insulating housing, and wherein the first insulating housing is provided with a recessed portion configured to receive the fitting projecting portion when the first and second insulating housings are engaged to each other.

13. The connector device according to claim 10, wherein the first projecting portion is configured to provide the first elastic force at an initial point of contact between the first projecting portion and the second projecting portion during the initial range of contact, and wherein the first projecting portion is configured to provide the second elastic force at a subsequent point of contact between the first projecting portion and the second projecting portion during the subsequent range of contact.

14. The connector device according to claim 13, wherein the first projecting portion comprises a mountain-like peak, the initial point and the subsequent point being located on opposite sides of the mountain-like peak, and wherein the mountain-like peak of the first projecting portion is configured to provide a transition between application of the first elastic force and the second elastic force to the second projecting portion.

15. The connector device according to claim 10, wherein the first elastic force acting in the first direction operates to electrically disconnect the first connector from the second connector, and wherein the second elastic force acting in the second direction operates to electrically connect the first connector to the second connector.

16. The connector device according to claim 10, wherein the third projecting portion comprises a mountain-like peak, and wherein the mountain-like peak of the third projecting portion is configured to provide a transition between application of the third elastic force to the fourth projecting portion in the first direction and application of the fourth elastic force to the fourth projecting portion in the second direction.

17. A connector device comprising:

a first connector including a first insulating housing, a plurality of first conductive terminals attached to the first insulating housing, and a first regulating member attached to the first insulating housing; and a second connector including a second insulating housing, a plurality of second conductive terminals attached to the second insulating housing, and a second regulating member attached to the second insulating housing, wherein, during an initial range of contact when fitting the first connector to the second connector, a first projecting portion associated with the first regulating member is configured to provide a second projecting portion associated with the second regulating member with a first elastic force acting in a first direction associated with disengaging the first and second insulating housings from each other, and a third projecting portion associated with at least one of the second conductive terminals is configured to provide a fourth projecting portion associated with at least one of the first conductive terminals with a third elastic force acting in the first direction, and wherein, during a subsequent range of contact when fitting the first connector to the second connector, the first projecting portion is configured to provide the second projecting portion with a second elastic force acting in a second direction associated with engaging the first and second insulating housings to each other, and the third projecting portion is configured to provide the fourth projecting portion with a fourth elastic force acting in the second direction.

18. The connector device according to claim 17, wherein the third projecting portion comprises a mountain-like peak, and wherein the mountain-like peak of the third projecting portion is configured to provide a transition between the initial range of contact and the subsequent range of contact.

* * * * *